US010882661B1

(12) United States Patent
Seidler

(10) Patent No.: US 10,882,661 B1
(45) Date of Patent: Jan. 5, 2021

(54) DEVICES AND METHODS RELATING TO MODULAR STORAGE

(71) Applicant: Concept Workshop Worldwide, LLC, New York, NY (US)

(72) Inventor: Stewart Seidler, New York, NY (US)

(73) Assignee: CONCEPT WORKSHOP WORLDWIDE, LLC, New York, NY (US)

( * ) Notice: Subject to any disclaimer, the term of this patent is extended or adjusted under 35 U.S.C. 154(b) by 143 days.

(21) Appl. No.: 16/358,089

(22) Filed: Mar. 19, 2019

Related U.S. Application Data

(63) Continuation-in-part of application No. 14/470,259, filed on Aug. 27, 2014, now abandoned.
(Continued)

(51) Int. Cl.
*A45D 33/00* (2006.01)
*A45D 33/22* (2006.01)
(Continued)

(52) U.S. Cl.
CPC ..... *B65D 21/0205* (2013.01); *A45C 13/002* (2013.01); *A45C 13/1069* (2013.01); *B65D 21/083* (2013.01); *A45C 5/005* (2013.01); *A45D 2040/0006* (2013.01); *B65D 5/66* (2013.01); *B65D 21/0209* (2013.01);
(Continued)

(58) Field of Classification Search
CPC ..... A45C 5/005; A45C 13/1069; A45C 13/02; A45C 13/002; A45D 33/006; A45D 33/18; A45D 33/20; A45D 33/24; A45D 33/22; A45D 33/26; A45D 40/24; A45D 40/22; A45D 40/18; A45D 40/221; A45D 40/222; A45D 2040/0006; B42D 1/06; B42D 3/02; B65D 5/66; B65D 5/6647; B65D 21/0209; B65D 21/083; B65D 21/0205; B65D 2313/04; B65D 77/006; H01F 7/0263; H01F 7/0252; H01F 7/04; H01F 7/02; Y10T 16/5401; Y10T 24/32; Y10T 292/11
USPC ..... 16/320; 24/303; 132/286, 293, 294, 296, 132/314, 315, 295, 333; 150/104, 105, 150/112, 113, 118; 190/110; 206/581, 206/818, 37, 38, 45.23; 220/230, 23.4, 220/324, 483, 4.22, 4.23, 520; 224/183; 292/251.5; 335/285, 306, 295, 296, 302
See application file for complete search history.

(56) References Cited

U.S. PATENT DOCUMENTS 1,682,534 A 8/1928 Jean
2,448,611 A 9/1948 Stanley
(Continued)

*Primary Examiner* — Gideon R Weinerth
(74) *Attorney, Agent, or Firm* — Carter, DeLuca & Farrell LLP

(57) ABSTRACT

In accordance with aspects of the present disclosure, an apparatus includes a holder having a flexible sheet with a foldable portion that is foldable along an axis to form an upper portion and a lower portion of the flexible sheet, wherein the upper portion contains at least one magnet embedded therein and the lower portion contains at least one magnet embedded therein. The apparatus further includes at least one rigid container dimensioned to fit within the holder when the holder is folded, where the rigid container includes at least a first magnet with the first magnet located to engage the at least one magnet embedded in the lower portion of the holder and the at least one magnet embedded in the upper portion of the holder.

10 Claims, 25 Drawing Sheets

Related U.S. Application Data

(60) Provisional application No. 61/870,289, filed on Aug. 27, 2013, provisional application No. 62/712,934, filed on Jul. 31, 2018.

(51) Int. Cl.

| | |
|---|---|
| ***A45D 40/00*** | (2006.01) |
| ***A45D 40/22*** | (2006.01) |
| ***B65D 21/00*** | (2006.01) |
| ***B65D 21/02*** | (2006.01) |
| ***B65D 21/08*** | (2006.01) |
| ***A45C 13/10*** | (2006.01) |
| ***A45C 13/00*** | (2006.01) |
| *A45C 5/00* | (2006.01) |
| *B65D 5/66* | (2006.01) |
| *B65D 77/00* | (2006.01) |
| *H01F 7/02* | (2006.01) |
| *H01F 7/04* | (2006.01) |

(52) U.S. Cl.

CPC ..... *B65D 77/006* (2013.01); *B65D 2313/04* (2013.01); *H01F 7/02* (2013.01); *H01F 7/0252* (2013.01); *H01F 7/0263* (2013.01); *H01F 7/04* (2013.01); *Y10T 16/5401* (2015.01); *Y10T 24/32* (2015.01); *Y10T 292/11* (2015.04)

(56) References Cited

U.S. PATENT DOCUMENTS

| | | | | |
|---|---|---|---|---|
| 2,623,566 | A | 12/1952 | Kibler | |
| 2,784,757 | A | 3/1957 | Bosca et al. | |
| 3,079,535 | A * | 2/1963 | Schultz | H01F 7/0226 335/295 |
| 3,223,898 | A * | 12/1965 | Bey | H01F 7/0226 335/295 |
| 3,583,729 | A | 6/1971 | De Groot | |
| 3,749,301 | A | 7/1973 | Peckar | |
| 3,751,839 | A * | 8/1973 | Mitchell | B42F 5/00 40/775 |
| 3,944,069 | A | 3/1976 | Eldridge, Jr. | |
| 4,018,237 | A | 4/1977 | Steiman | |
| 4,255,837 | A | 3/1981 | Holtz | |
| 4,388,935 | A | 6/1983 | Napolitane | |
| 4,588,209 | A | 5/1986 | Zebrowski et al. | |
| 4,589,430 | A | 5/1986 | Sussman | |
| 4,620,725 | A | 11/1986 | Maehashi | |
| 4,821,751 | A | 4/1989 | Chen | |
| 5,005,697 | A | 4/1991 | Jimbo et al. | |
| 5,135,012 | A | 8/1992 | Kamen et al. | |
| 5,148,916 | A | 9/1992 | Tillyer, Sr. | |
| 5,328,206 | A | 7/1994 | Scott | |
| 5,375,883 | A | 12/1994 | Wyant | |
| 5,425,160 | A | 6/1995 | Krapf | |
| 5,575,503 | A | 11/1996 | Takahashi | |
| 5,682,653 | A | 11/1997 | Berglof et al. | |
| 5,702,126 | A | 12/1997 | Engel | |
| 5,709,409 | A | 1/1998 | Engel | |
| 5,984,441 | A | 11/1999 | Stokhuijzen | |
| 6,457,239 | B1 | 10/2002 | McLaughlin | |
| 6,598,752 | B1 | 7/2003 | Davidov | |
| D482,162 | S | 11/2003 | Bostroem | |
| 6,793,251 | B2 | 9/2004 | Stark | |
| 6,831,541 | B1 | 12/2004 | Seidler | |
| 6,961,977 | B2 | 11/2005 | Seidler | |
| 7,070,048 | B2 | 7/2006 | Gelardi et al. | |
| 7,089,627 | B2 * | 8/2006 | Seidler | B65D 51/04 16/320 |
| 7,404,215 | B2 | 7/2008 | Allen | |
| 7,467,440 | B2 * | 12/2008 | Seidler | B65D 51/04 16/320 |
| D601,757 | S * | 10/2009 | Sagel | D28/83 |
| 7,644,489 | B2 * | 1/2010 | Arora | B81C 1/00007 29/607 |
| 8,662,086 | B2 | 3/2014 | Kesselman | |
| D723,742 | S | 3/2015 | Shteysel | |
| 9,206,630 | B2 | 12/2015 | Kim | |
| 9,526,309 | B2 | 12/2016 | Huyke-Phillips | |
| 10,710,390 | B2 * | 7/2020 | Good-Man | B42D 13/00 |
| 2002/0153074 | A1 * | 10/2002 | Chen | A45C 3/06 150/113 |
| 2002/0179485 | A1 | 12/2002 | Shih | |
| 2003/0167599 | A1 | 9/2003 | Seidler | |
| 2004/0134030 | A1 | 7/2004 | Seidler | |
| 2004/0183313 | A1 | 9/2004 | Sherman et al. | |
| 2004/0200755 | A1 | 10/2004 | Gueret | |
| 2006/0027481 | A1 | 2/2006 | Gelardi et al. | |
| 2006/0065558 | A1 | 3/2006 | Chang | |
| 2006/0124150 | A1 | 6/2006 | McEvoy-Sherman | |
| 2006/0231117 | A1 | 10/2006 | Manougian et al. | |
| 2007/0049477 | A1 | 3/2007 | Hester et al. | |
| 2007/0063004 | A1 * | 3/2007 | Weinberg | B65D 21/0208 229/120.01 |
| 2007/0252377 | A1 | 11/2007 | Ei-Sorroge | |
| 2010/0024271 | A1 | 2/2010 | Seidler | |
| 2010/0031971 | A1 | 2/2010 | Ha | |
| 2010/0089793 | A1 | 4/2010 | Plassmeyer | |
| 2011/0061675 | A1 | 3/2011 | McKinley | |
| 2011/0132508 | A1 * | 6/2011 | Castellucci | A45C 13/10 150/113 |
| 2011/0155752 | A1 | 6/2011 | Ha | |
| 2011/0253167 | A1 | 10/2011 | Shteysel | |
| 2012/0112448 | A1 | 5/2012 | Lo et al. | |
| 2012/0200074 | A1 | 8/2012 | Kuch et al. | |
| 2013/0113584 | A1 * | 5/2013 | Hunts | H01F 7/0252 335/285 |
| 2013/0133686 | A1 | 5/2013 | Shteysel | |
| 2014/0034080 | A1 | 2/2014 | Paquet et al. | |
| 2014/0125047 | A1 | 5/2014 | Thibierge et al. | |
| 2014/0238434 | A1 | 8/2014 | Blanch | |
| 2014/0299151 | A1 | 10/2014 | Stroud | |
| 2015/0224806 | A1 | 8/2015 | Good-Man | |
| 2015/0367671 | A1 | 12/2015 | Song et al. | |
| 2015/0380141 | A1 | 12/2015 | Mayfield | |
| 2017/0143099 | A1 | 5/2017 | Carraro | |
| 2017/0269634 | A1 * | 9/2017 | Ji | H01F 7/0263 |
| 2018/0263361 | A1 * | 9/2018 | Langdon | A45D 33/20 |
| 2018/0335800 | A1 * | 11/2018 | Kim | G06F 1/1681 |
| 2019/0059557 | A1 * | 2/2019 | Kehoe | A45D 42/00 |
| 2019/0075910 | A1 * | 3/2019 | Torres | A45D 42/02 |
| 2019/0110578 | A1 * | 4/2019 | Maurin | A45D 40/22 |
| 2019/0282039 | A1 * | 9/2019 | Lewis | A47K 10/32 |
| 2019/0374004 | A1 * | 12/2019 | Martins | A45D 33/003 |
| 2020/0013531 | A1 * | 1/2020 | Tazbaz | E05B 63/0056 |
| 2020/0039699 | A1 * | 2/2020 | Wu | B65D 43/22 |

* cited by examiner

DEVICES AND METHODS RELATING TO MODULAR STORAGE

CROSS-REFERENCE TO RELATED APPLICATIONS

The present application is a continuation-in-part of U.S. application Ser. No. 14/470,259, filed Aug. 27, 2014, which claims the benefit of and priority to U.S. Provisional Application No. 61/870,289, filed Aug. 27, 2013. The present application also claims the benefit of and priority to U.S. Provisional Application No. 62/712,934, filed Jul. 31, 2018. The entire contents of each of the foregoing applications are hereby incorporated by reference herein.

BACKGROUND

Typically, when someone leaves their home or office, they carry their smaller possessions in a large container such as a handbag, brief case, clothing pocket, or backpack. They might put their frequently used small items, such as jewelry, money, and change, into a purse. They might have a separate bag for things that are prone to be dirty such as cosmetics and related implements. Different cosmetic products are packaged in separate containers—multiple compacts for eye shadows and other facial cosmetics, a lipstick case, mirror case, and implement case. These purses and cosmetic packages are in turn tossed into the larger bag. Some items are distributed into pockets.

Storage of these items in a bag is a typically disorganized affair. Different cosmetic compacts may be hard to find or implements such as brushes might be in one case and the cosmetic compact in another. There is a possibility of forgetting to pack a critical implement that would be necessary for using an essential cosmetic.

In the case of cosmetics, one solution offered by manufacturers is to collect all the cosmetics together and supply a cosmetic kit where the different cosmetic products and implements are included in one large box with multiple compartments built in. The problem with such cases is that they are heavy and cumbersome to carry about. The user usually does not need to carry all the products included.

When a user carries around many different items, they may need to enclose them in a variety of containers including small boxes, pouches, or envelopes, or they may bind the items with clips and rubber bands. Not only is there no true organization of the items, there is a problem of securing loose items into a container. Loosely placed implements, fragile jewelry, and cosmetic pencils can be easily damaged especially when tossed into a container such as a large handbag or back pack.

There are various solutions on the market. There is the versatile handbag, carrying case, or knapsack. These are large spacious products that offer pockets and compartments but, offer little in modularity or organization.

The user could have a special container for each type of item, but that results in multiple dedicated containers thrown into a large handbag. This practice does not solve the organizational problem and requires extra space to accommodate the size of the additional containers. Furthermore, multiple packages require more packaging waste, since each package requires material to provide for such components as covers and secondary packaging.

Another solution that is available comprises a binder with rings, clips, or other mechanical fastening devices set within a relatively rigid outer holder. Such a device is cumbersome to use, unattractive and often designed cheaply.

SUMMARY

The present disclosure relates to devices for those consumers who want an easy-to-use, attractive, and lightweight holder to securely organize and carry around their everyday items so that they are easily accessible. The device offers a modular function whereby consumers only need to carry those items that they would require to carry with them. The modular containers are designed such that they can be either carried outside, or stored at a home or office storage area, without the necessity of removing individual products or items from the unit itself.

Embodiments described herein provide solutions to the above-described problems of organization, security, and usability.

One exemplary embodiment allows a user to store individual items in attractive and secure rigid containers design to securely hold items and to modularly rigid containers. Such a set of rigid containers can be described as a storage unit that may be set on a table or in a drawer located in the consumer's home or office. The rigid containers would be magnetically held together. The consumer would select those rigid containers that contain the required items they wish to take and insert them into a portable flexible wallet-like holder. The flexible holder would be flat units that bend along an axis that approximately divides the holder into two sections. Those rigid containers that the consumer selects to bring would be magnetically secured into the flexible holder. Individual flexible holders might themselves be magnetically attachable to other flexible holders such that the user could carry multiple holders together. The magnets would have definite north-south pole orientations to allow maximum attractive strength between the rigid containers that incorporate them.

Another embodiment would allow some magnetizable elements to be used in lieu of magnets when feasible.

Another exemplary embodiment of the device would include a set of magnets incorporated in the containers and a corresponding set of magnets incorporated in the holders, where the magnets of both sets are strategically oriented along their north-south pole axes, such that the user may insert the rigid containers into the holder without regard to the container's orientation, and such that the magnets in the containers would correctly engage with the magnets in the flexible holder. This would be accomplished by alternating the north-south orientations so that the magnetic poles in multiple rigid containers and the holders assuring that the magnets would always match up.

Another embodiment of the device would insert additional magnets into the container, the holder, or both to further allow flexibility in orienting the container within the holder.

Another exemplary embodiment of the device would be to vary the distances between sets of magnets or magnetizable elements in the rigid containers and sets of magnets or magnetizable elements in the holders. It is accepted that the greater the distance between north-south poles of magnetic elements, the less force that the elements would attract each other. Likewise, the greater the distance between a magnet and a magnetizable element, the less attractive force between them. And finally, the greater the distance between two of the same poles of a magnetic element, that is, north-north or south-south, the less the repelling force between the elements. Therefore, the greater the distance between magnetic elements incorporated in containers and holders, the less the containers would be attracted to the holder. Likewise, the greater the distance between magnetic elements incorporated in two pairs of containers, the less the containers would be attracted to one another. If a typical device such as one including a holder and two containers is configured such the distance between magnetic elements of the holder and the containers is less than the distance between the pair of containers, the device will naturally open where the force is least, that is, between the pair of containers.

Another embodiment can include varying distances between individual containers such that they may open between pairs of containers whose incorporated magnetic elements are further than between other pairs.

Another embodiment can include configuring the distance between the corresponding magnetic elements of the holder and a container to be greater than between a pair of containers such that the device would first open between the holder and container.

Another embodiment might utilize pairs of repelling magnets to open various portions of the device in favor of opening between attractive sets of magnetic elements.

Another exemplary embodiment uses sets of magnets that have different chemical compositions such that their intrinsic strengths are increased or reduced. For example, a pair of neodymium magnets designated as N45, aligned such that their poles are opposite, would have a substantially larger attractive force between them, than would a pair of N30 magnetic elements. The magnetic elements could be incorporated in the device such that the device could selectively open between containers, or between a container and the holder by virtue of the weaker force between magnets.

Another embodiment incorporates a set of magnetic elements in either the holder or the container, and a set of corresponding magnetizable, but non-magnetic elements, such as iron, with enough permeability to react to a magnetic field. The force between such a pair of elements would typically be less than that between a pair of magnets. Therefore, the device configured with combinations of magnetizable and magnetic elements would preferably open between a magnet and a magnetizable element.

Another exemplary embodiment teaches a flexible holder which can hold varying numbers of containers by virtue of an adjustable folding axis.

Another embodiment of the device would include a septum that would be inserted between containers, or between containers and the flexible holder, to control the distance between the magnetic magnetizable elements.

Another embodiment includes a septum that is designed to protect items from falling out of the container and into another container.

Another embodiment includes a septum that serves further functionality such as a mirror or holding device.

Another embodiment includes a septum that is connected to, or part of the holder.

Another exemplary embodiment includes multiple holders that may themselves magnetically engage with one another to form a larger device.

Another embodiment where the containers may be removed from the holder and act as an independent storage device or be integrated into a separate storage unit.

Another embodiment where the device is designed to include multiple containers of various shapes and wall configurations.

Another embodiment where the container engages with the holder such that it can swivel out of the holder about an axis of a pair of magnets.

The figures herein depict various embodiments, for purposes of description and explanation, but are not intended to otherwise limit the scope of exemplary embodiments.

DETAILED DESCRIPTION

FIGS. 1-4 illustrate one or more exemplary embodiments. An exemplary holding device is a rectangular cosmetic package with modular containers holding cosmetic product accessible from the top, and an outer holder made of polyurethane.

Figure 1:
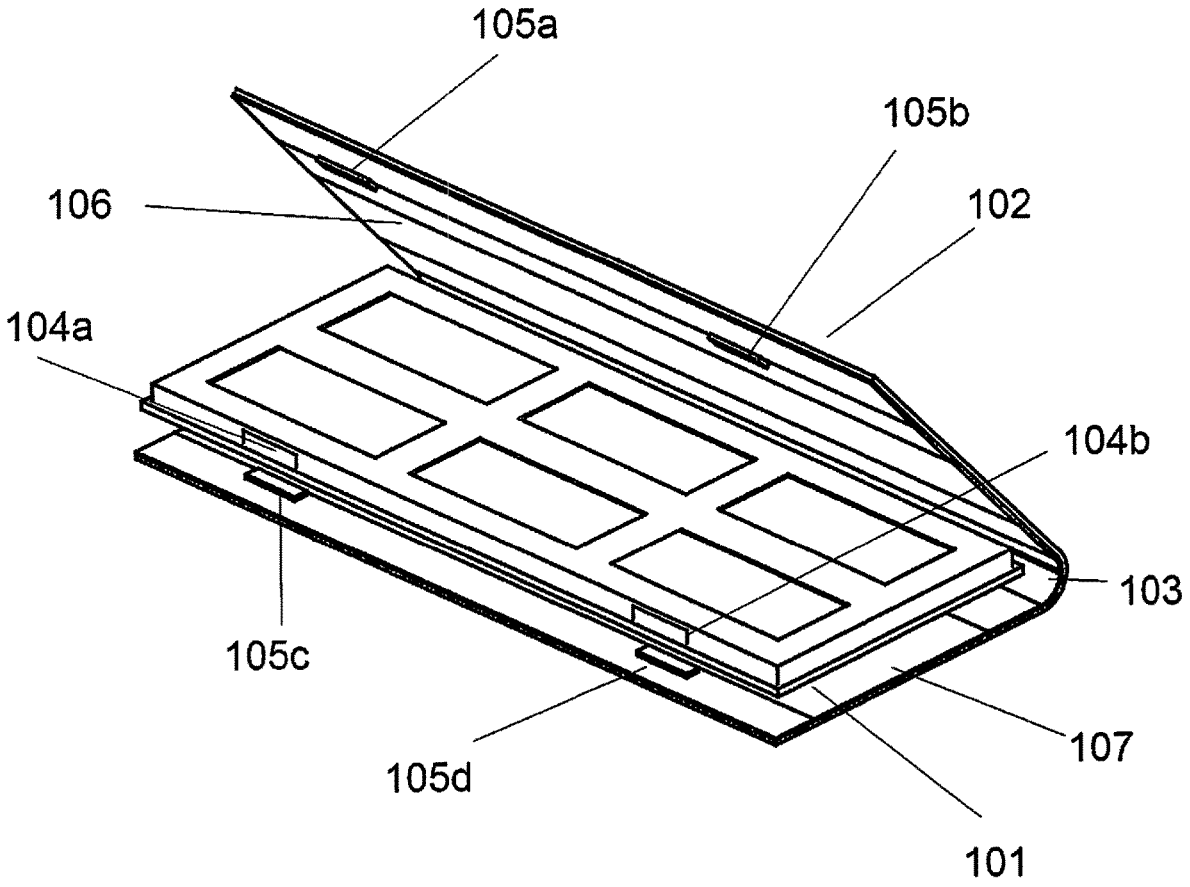
FIGS. 1-4 depict an exemplary holding device comprising a cosmetic holder with modular containers held together by magnets oriented in different directions.

FIG. 1 shows a container 101. There is a flexible holder 102 that is bendable along a folding axis 103. In this embodiment, there is a pair of container magnets 104*a* and 104*b* embedded in the container and oriented as described in FIG. 2. There are two pairs of holder magnets 105*a*-105*d* embedded in the flexible holder; one pair—105*a* and 105*b*—is located on the holder top surface/upper portion 106 and one pair—105*c* and 105*d*—is located on the holder bottom surface/lower portion 107 and oriented as described in FIG. 2.

Figure 2:
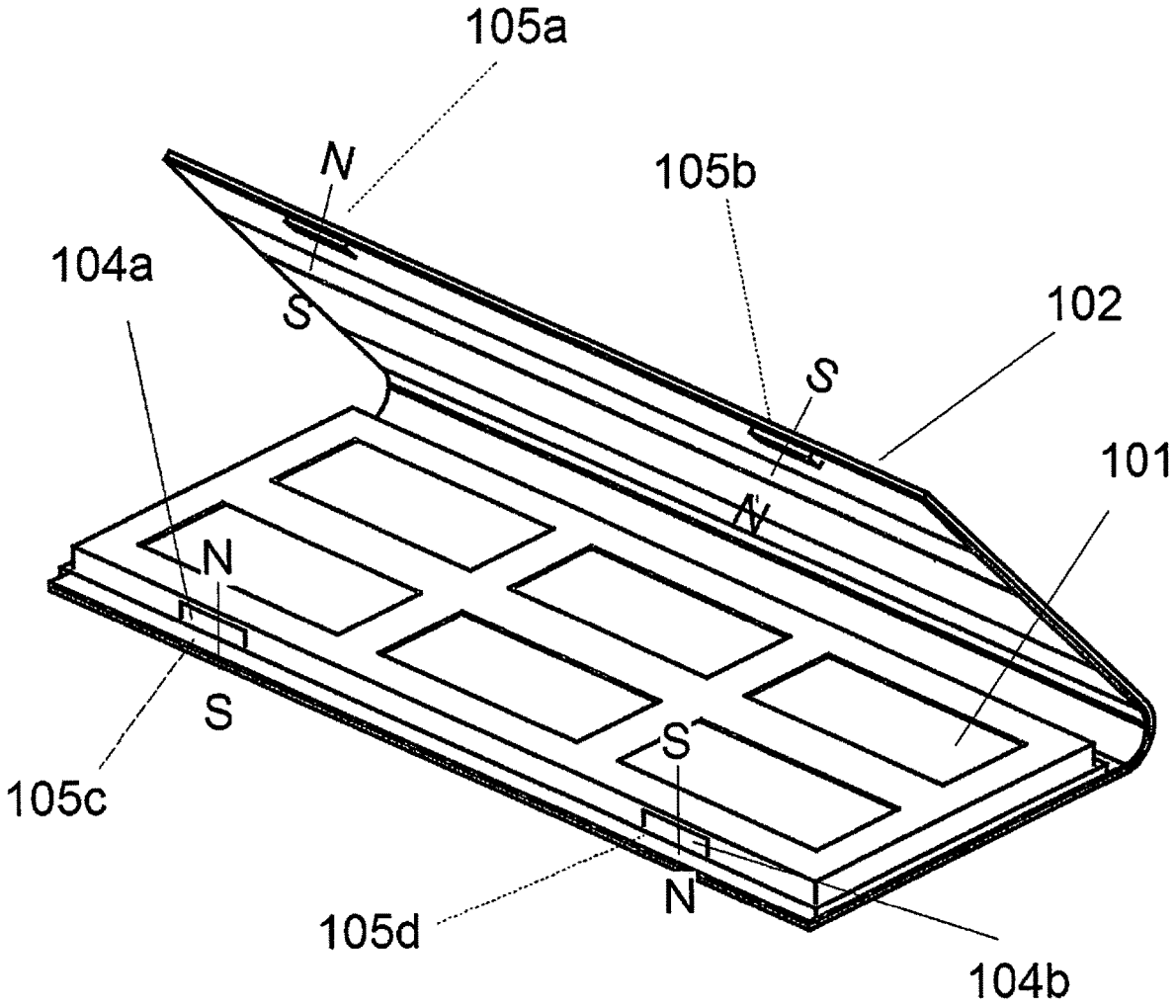

FIG. 2 shows the same drawing as in FIG. 1 but with a set of described magnetic orientations. In this drawing the holder and container magnets 105*a*, 104*a*, and 105*c* are oriented in north-south (north facing upwards and south facing downwards) directions such that when the container 101 is inserted into the holder 102, the magnets can magnetically engage with one another. Likewise, 105*b*, 104*b*, and 105*d* are oriented in south-north (south facing upwards and north facing downwards) directions such that when the container is inserted into the holder, the magnets can magnetically engage with one another.

Figure 3A:
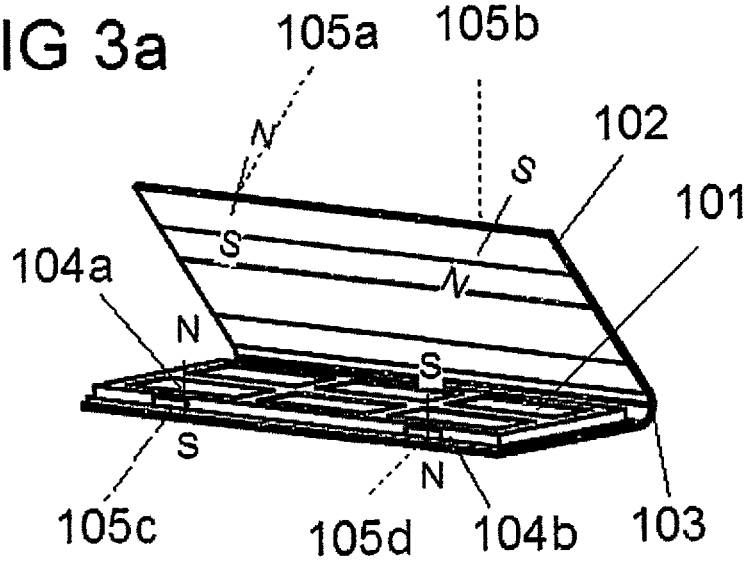
Figure 3B:
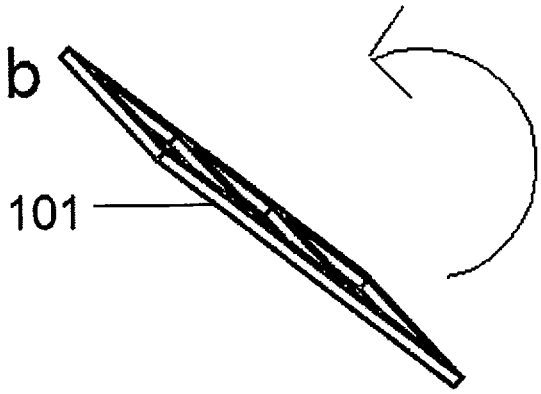
Figure 3C:
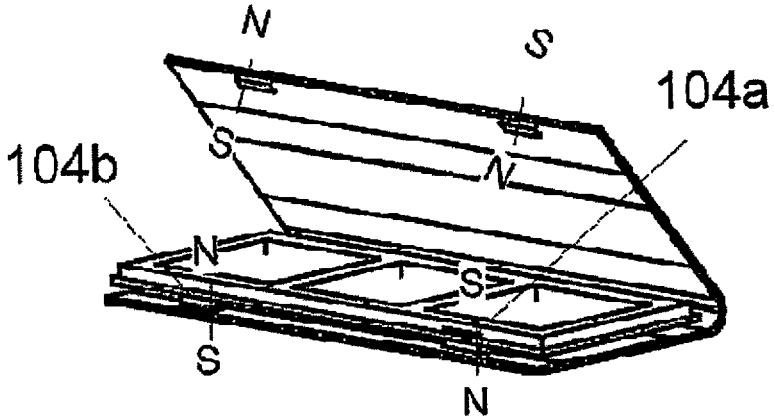

FIGS. 3*a*-3*c* show how the described container 101 can be inserted into the holder 102 in two orientations. In both orientations, the container is described whereby the magnets are facing outwards and are on the side farthest from the holder's axis 103. Furthermore, the container has two usable sides; a top side with six small spaces for holding a product item, and a bottom side with 3 spaces for holding a product item. This container embodiment is offered to illustrate the concept and does not limit the scope of the present disclosure. FIG. 3*a* shows the container with the six holed side of the container 101 facing upwards. Embedded into the left side of the container is a magnet 104*a* whose north side faces upwards. Embedded on the right side of the container is a magnet 104*b* with the south side of the magnet facing upwards.

FIG. 3*b* shows the action of flipping the container 101 about such that the magnets still face to the front.

FIG. 3*c* shows the result of flipping the container 101. The result of the reorientation shows the left side with the container magnet 104*b* that was formerly on the right side. Its magnetic orientation is now with the north side facing upwards. The right side is now the container magnet 104*a* that was formerly on the left side. Its magnetic orientation is now with the south side facing upwards. The consumer can insert the container as either orientation. Therefore, the consumer does not need to consider the correct orientation when using the device.

Figure 3D:
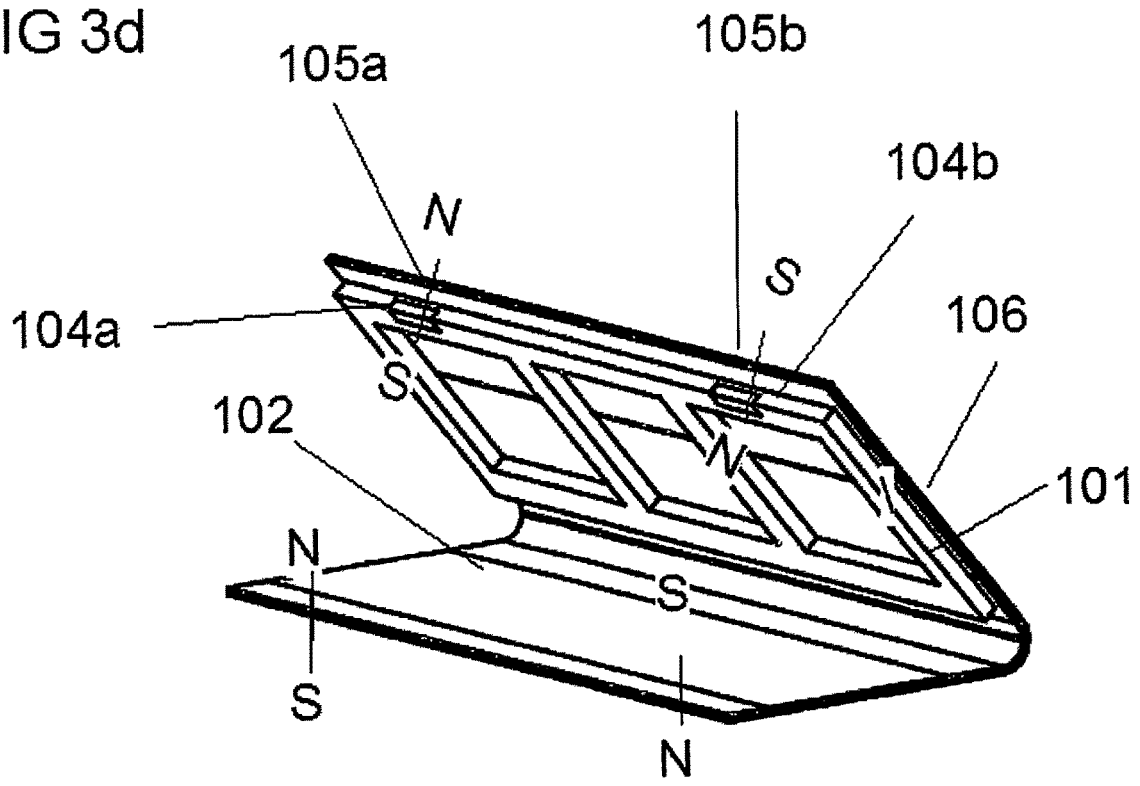

FIG. 3*d* shows the container 101 in FIG. 3*a* where the container magnets have the same orientations relative to the magnets in holder 102 but, where the container magnets 104*a* and 104*b* are attached respectively to holder magnets 105*a* and 105*b*.

Figure 3E:
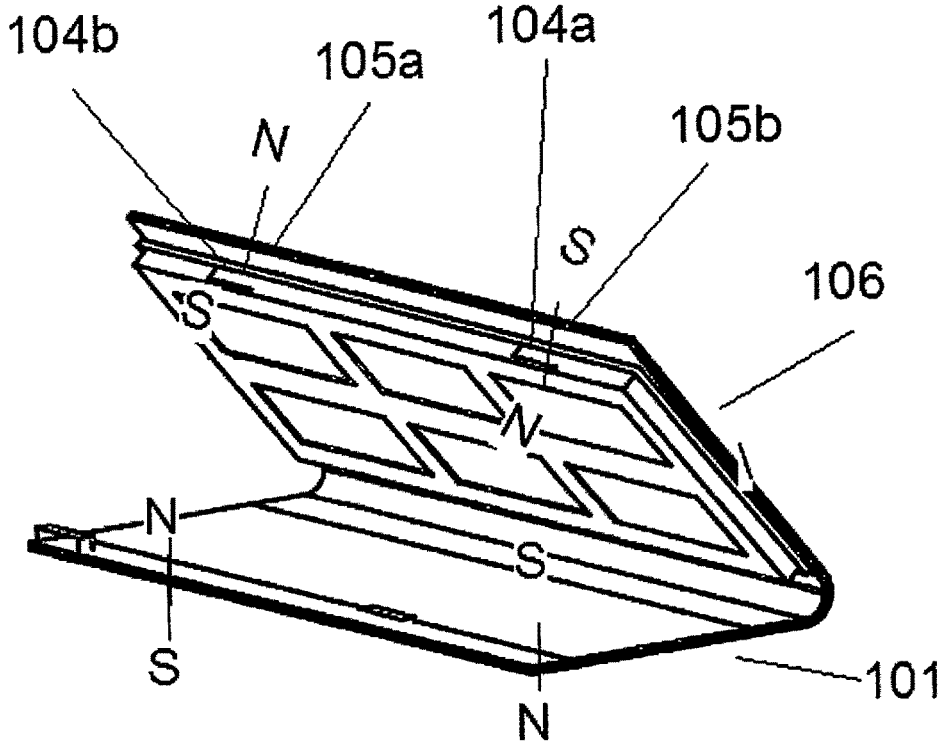

FIG. 3*e* shows the container 101 in FIG. 3*c* where the container magnets have the same orientations relative to the magnets in holder 102 but, where the container magnets 104*b* and 104*a* are attached respectively to holder magnets 105*a* and 105*b*.

Figure 4:
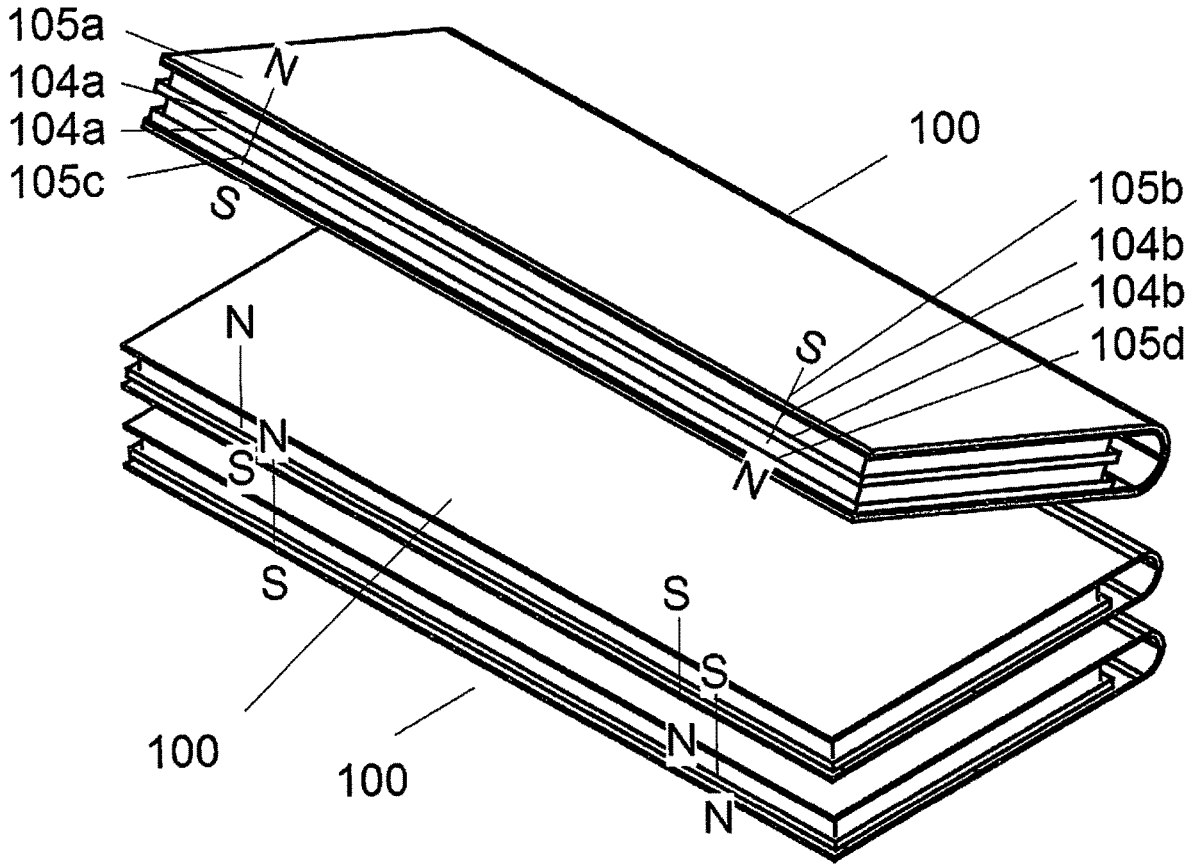

FIG. 4 shows a set of three devices 100 consisting of holders 102 each magnetically connected to and containing containers 101. The devices are connected via magnetic force between the column of container and holder magnets or magnetic elements 105*a* and 105*c* on the left sides and, 105*b* and 105*d* on the right sides. As with the interaction between containers and holders described in FIGS. 3*a*-3*c*, the individual devices can be flipped about so that the consumer does not need to consider a correct orientation when grouping the devices.

Figure 24:
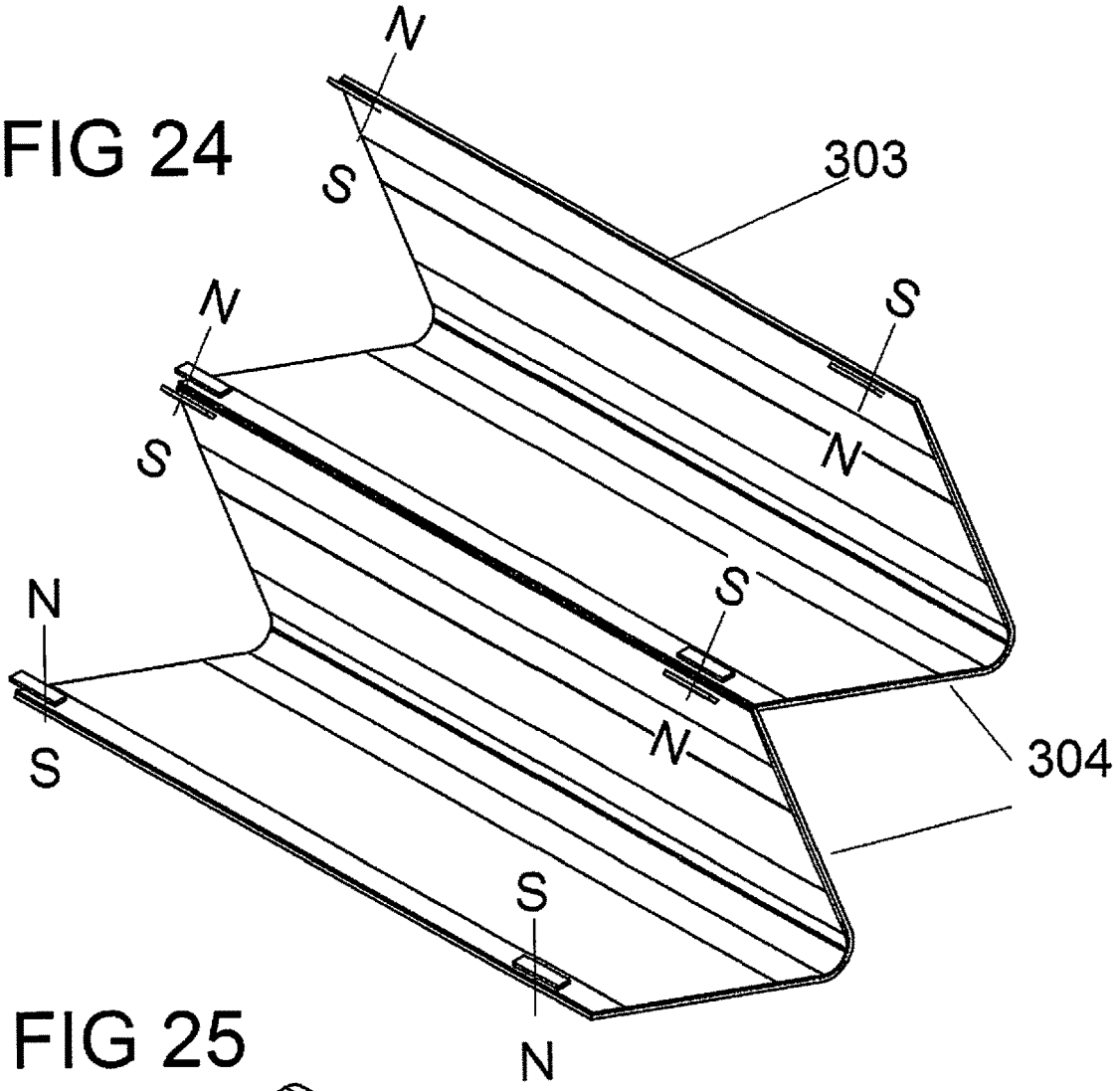

This specific configuration as described does not preclude other configurations of the placement of the magnets with the containers or holders. For instance, the magnets do not need to be located in the front of the holder. They could be set farther back towards the folding axis 103 or, farther towards opposite corners of the holder. Furthermore, though the depicted holder is rectangular, in various embodiments, it could be formed as other shapes such as semicircles, hexagons, or pentagons as shown in FIG. 24.

Furthermore, magnetizable elements such as certain steels can be substituted for the magnets in the container as long as there are corresponding magnets in the flexible holder that are sufficiently strong and correctly positioned such that they can engage the magnetizable elements.

FIGS. 5-11 show how by varying either the distance between magnets or, the strength of the magnets and magnetic elements, the way that the device opens can be controlled.

Various types of magnets yield different flux density characteristics. These densities represent the strength exerted on an object, at a set position and distance from the magnet. One of the factors, relevant to this invention that determines the force that a magnet exerts on an object is the chemical compositions of the magnet and the target object, the latter which could itself be a magnet or, a magnetizable element. The magnetic materials referenced in the exemplary embodiments are assumed to be neodymium, one of the most commonly used rare-earth magnets used for these applications. The strength is specified commercially by a range of numerals ranging from N30 and N50, the latter being the strongest. All other variables being equal, the north pole of a magnet rated as N35 interacting with the south pole of another magnet rated at N40, will be more strongly attracted to the target than it would to a magnetizable target such as iron or steel, neither of which have substantial innate magnetic properties. Other materials that can be used as magnets are rare-earths samarium-cobalt, alnico, or ferrite. Examples of commonly used magnetizable elements include iron, nickel, and some steels.

Another factor that determines the force that a magnet exerts on an object is the distance between them. As the distance between two magnets. or, a magnet and a magnetizable element decreases, the magnetic force between the two entities increases. Other factors that play a role in the interaction between magnetic substances include ambient temperature, shape of the elements involved, and the coating or materials that might be placed between the elements. But, for the purpose of describing the disclosed devices, these factors are not described in detail as they would be understood by persons skilled in the art.

Figure 5:
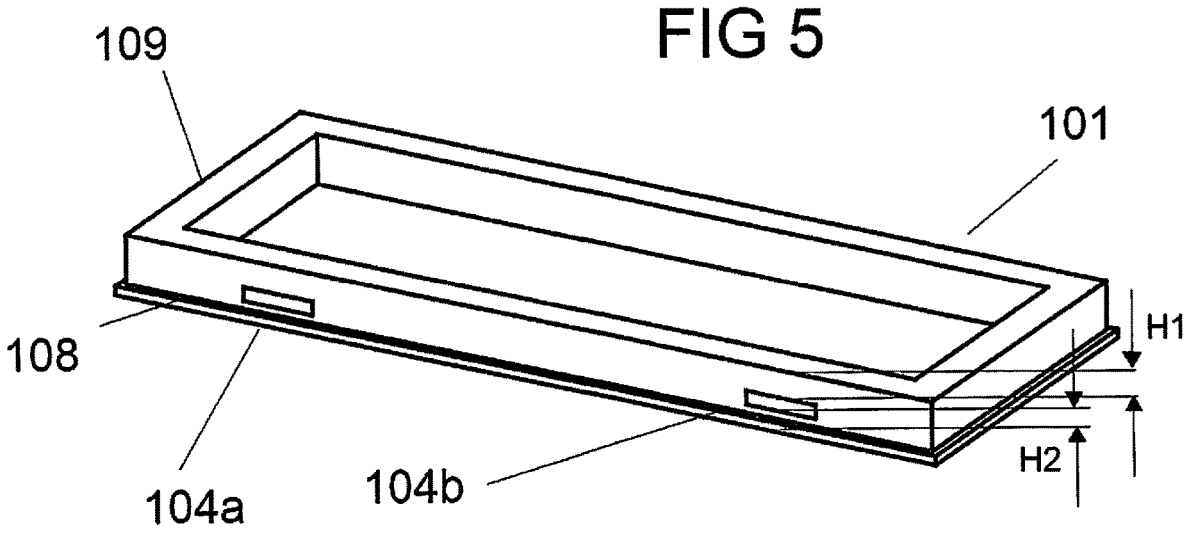
FIGS. 5-11*b* depict an exemplary holding device comprising holders and containers whose respective magnets are embedded such that the distances between engaged magnets and/or the individual strengths of the magnets are varied to control how the device opens.

FIG. 5 is an exemplary embodiment of a container 101 embedded with magnets 104*a* and 104*b*. Both magnets are level with each other. There is a container top surface 109 and a container bottom surface 108. The distance between the upper surface of the of the holder magnet 104*b* on the right side, and the container top surface, is H1. The distance between the lower surface of the holder magnet 104*b* on the right side, and the container bottom surface is H2. Likewise, the distance between the upper surface of the of the holder magnet 104*a* on the left side, and the container top surface is H1. The distance between the lower surface of the holder magnet 104*a* on the left side, and the container bottom surface is H2. In this embodiment, the magnets can be magnetically oriented in the same direction or, different directions, as long as one set of one or more magnets may interact with a corresponding set in an adjacent container or holder.

Figure 6:
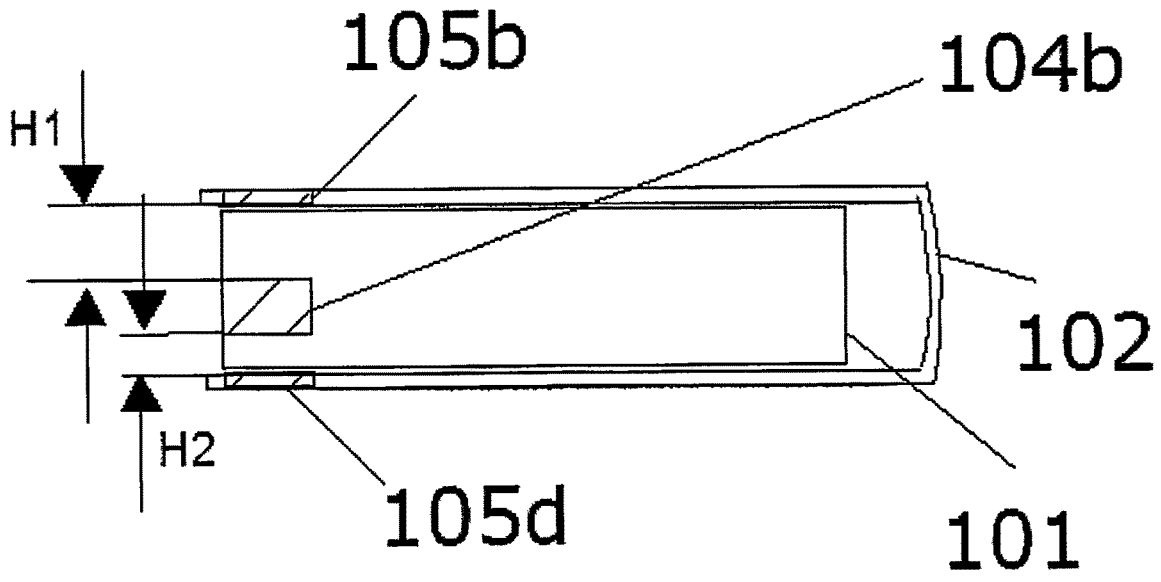

FIG. 6 shows a cross-sectional side view of the same container 101 of FIG. 5 when it is inserted into the flexible holder 102. The plane of the cross-section slices through the set of magnets 105*b*, 104*b*, and 104*d*. It is assumed that the holder magnet 105*b* is flush with the holder top surface 106 and the holder magnet 105*d* is flush with the holder bottom surface 107. The height H1 is greater than H2. Therefore, the magnetic attraction between the holder magnet 105*b*, and the container magnet 104*b*, will be less than the magnetic attraction between the holder magnet 105*d*, and the container magnet 104*b*. Because the force between the pair of magnets 105*b* and 104*b* is weaker than the force between the pair of magnets 105*d* and 104*b*, the device will first open between the magnets 105*b* and 104*b*. The magnets do not need to be flush to the container top and bottom surfaces for the device to function as described. They could be embedded within the holder's top and bottom surfaces. But, the relative distances should be configured as described herein.

Figure 7:
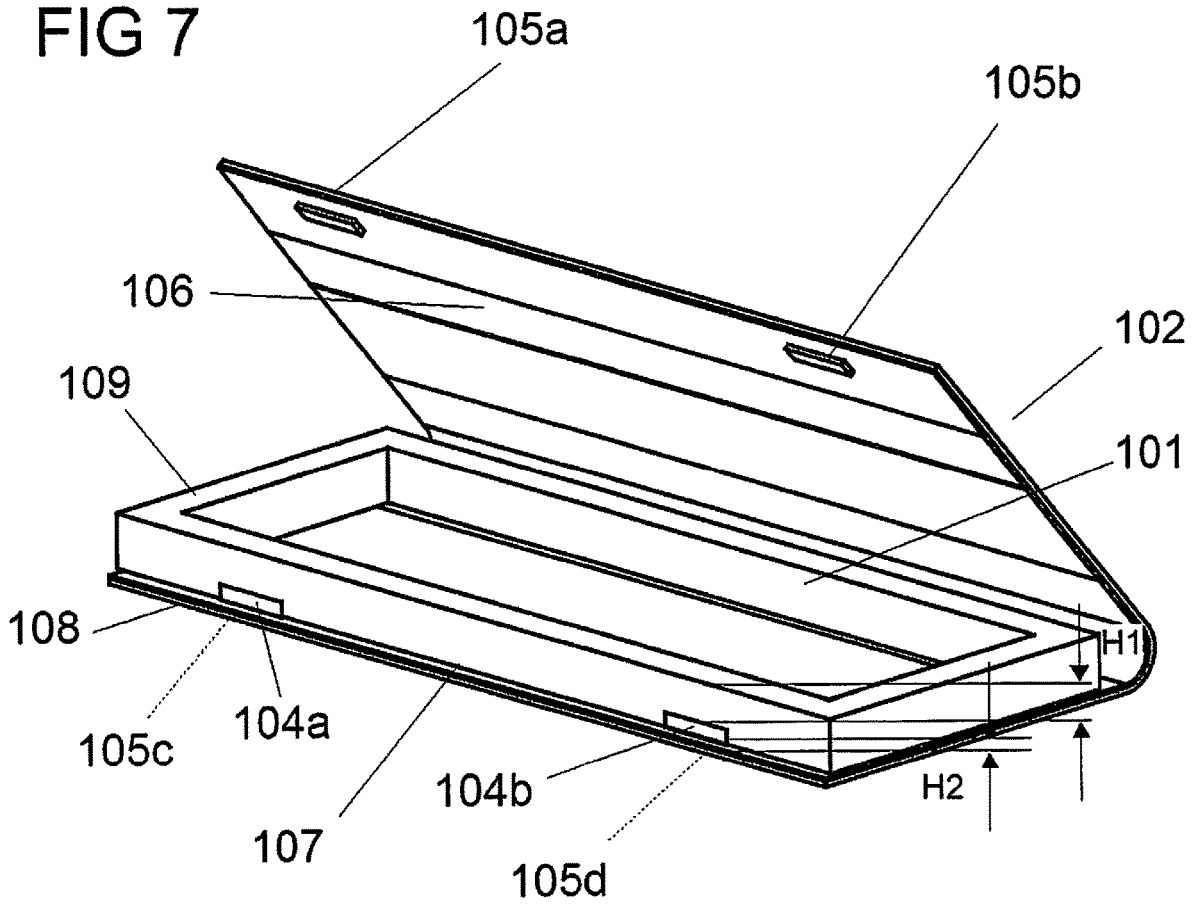

FIG. 7 shows an embodiment of the device with the flexible holder 102, container 101, holder magnets 105*a*-105*d*, and container magnets 104*a*-104*b*. As the distance H1 is greater than H2, the total magnetic attraction between the container magnets 104*b* and 104*a*, and respectively the holder magnets 105*a* and 105*b*, is less than the total magnetic attraction between the container magnets 104*b* and 104*a*, and respectively the holder magnets 105*c* and 105*d*. The device will therefore first open between the holder top surface 106 and the container top surface level 109.

Figure 8:
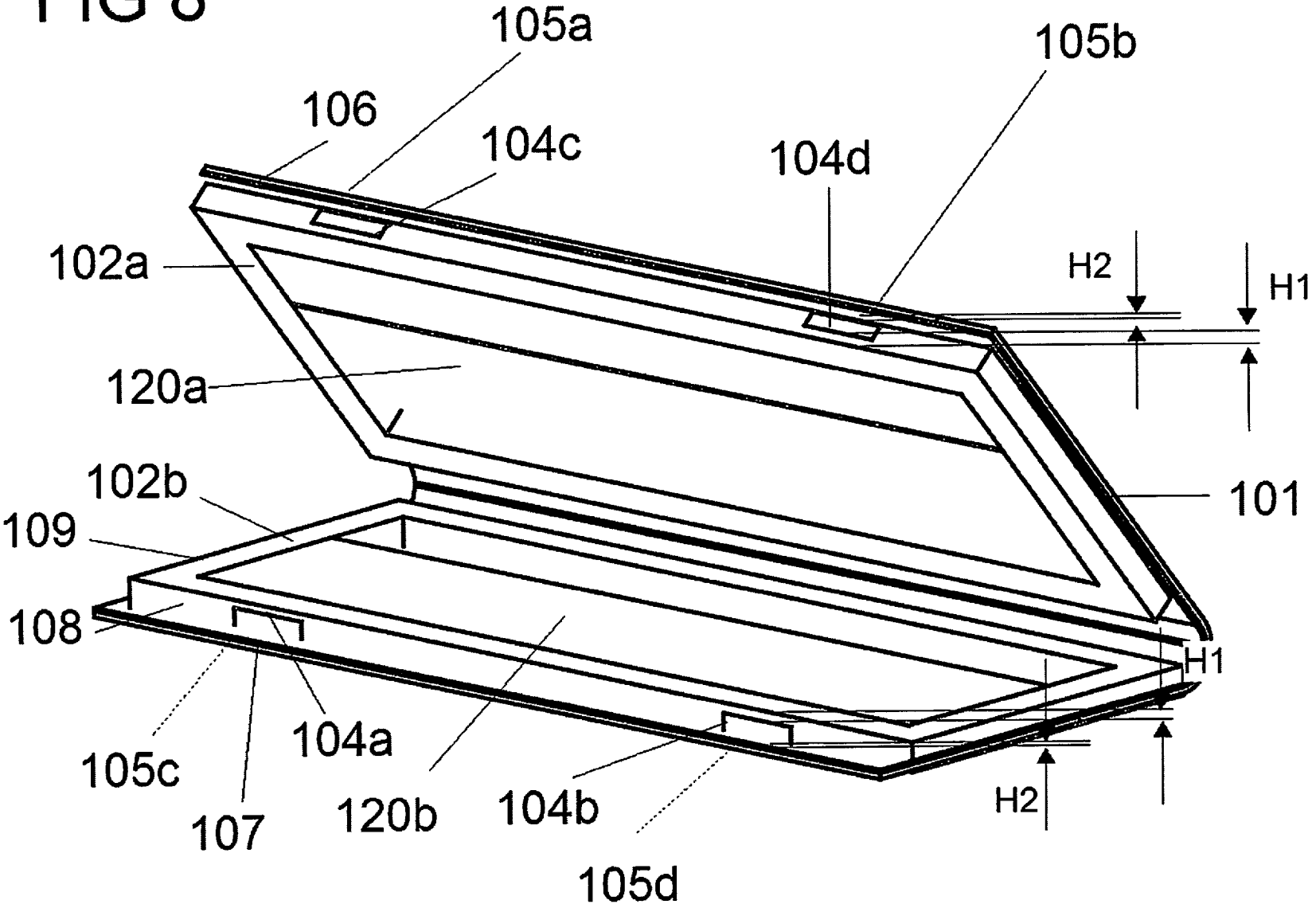

FIG. 8 shows an exemplary device with two containers, including a container 102*a* with embedded magnets 104*a* and 104*b*, and a container 102*b* with embedded magnets 104*a* and 104*b*. The containers are inserted into the flexible holder 101 such that the corresponding product openings 120*a* and 120*b* face each other. Into each container are embedded a pair of container magnets, respectively 104*c*-*d* and 104*a*-104*b*. The flexible holder has two pairs of magnets 105*a*-105*b* and 105*c*-105*d* set within and flush with respectively the holder top surface 106, and the holder bottom surface 107. The distances between the pairs of container magnets and the pairs of holder magnets are each H2 in this example. When the device is in a closed position, the distances between the holder magnet pair 104*c*-*d* and holder magnet pair 104*a*-104*b* are H1. H1 is greater than H2. Therefore the magnetic forces that attract the described containers together are less than the magnetic forces that attract either of the containers to the holder. The device will therefore first open between the two containers. Though the distances H2 between the container magnets and the respective holder magnets are the same in the illustration, they could be different in various embodiments. Even in such variations, the force between sections of the device that are first opened, is less than the force between sections of the device that are not first opened.

Figure 9A:
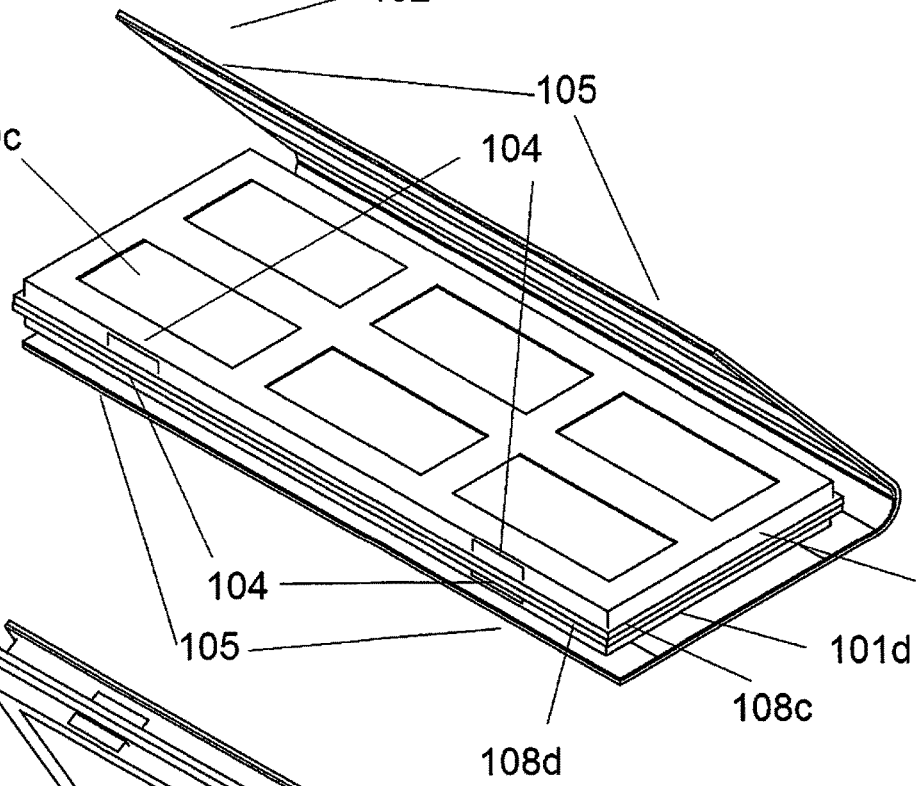
Figure 9B:
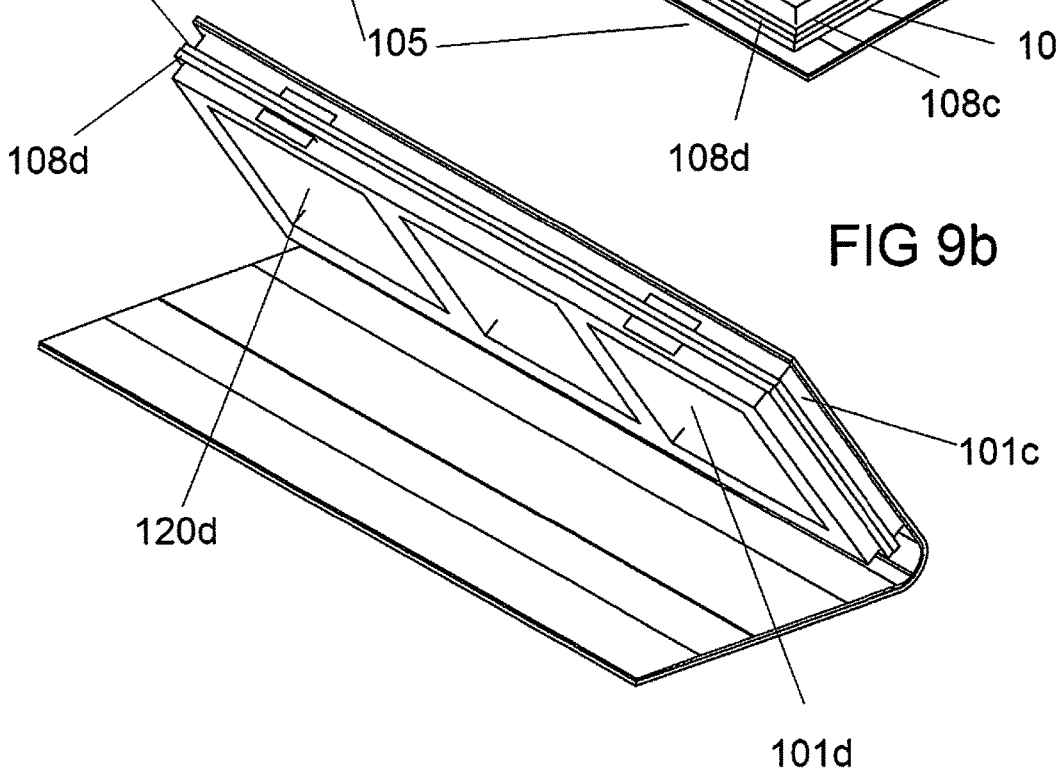

FIG. 9*a*-9*b* shows another exemplary embodiment where the product openings 120*c* and 120*d* of containers 101*c* and 101*d* face away from each other, such that the containers are magnetically engaged via their container bottom surfaces 108*c* and 108*d*. FIG. 9*a* shows the product area of 120*c*. FIG. 9*b* exposes product area 120*d*. There are two sets of holder magnets 104 and two sets of holder magnets 105. Because the magnetic attractive force between the container magnets is greater than the magnetic force between container magnets and the holder magnets, the device will first open between the latter pairs of magnets.

Figure 10:
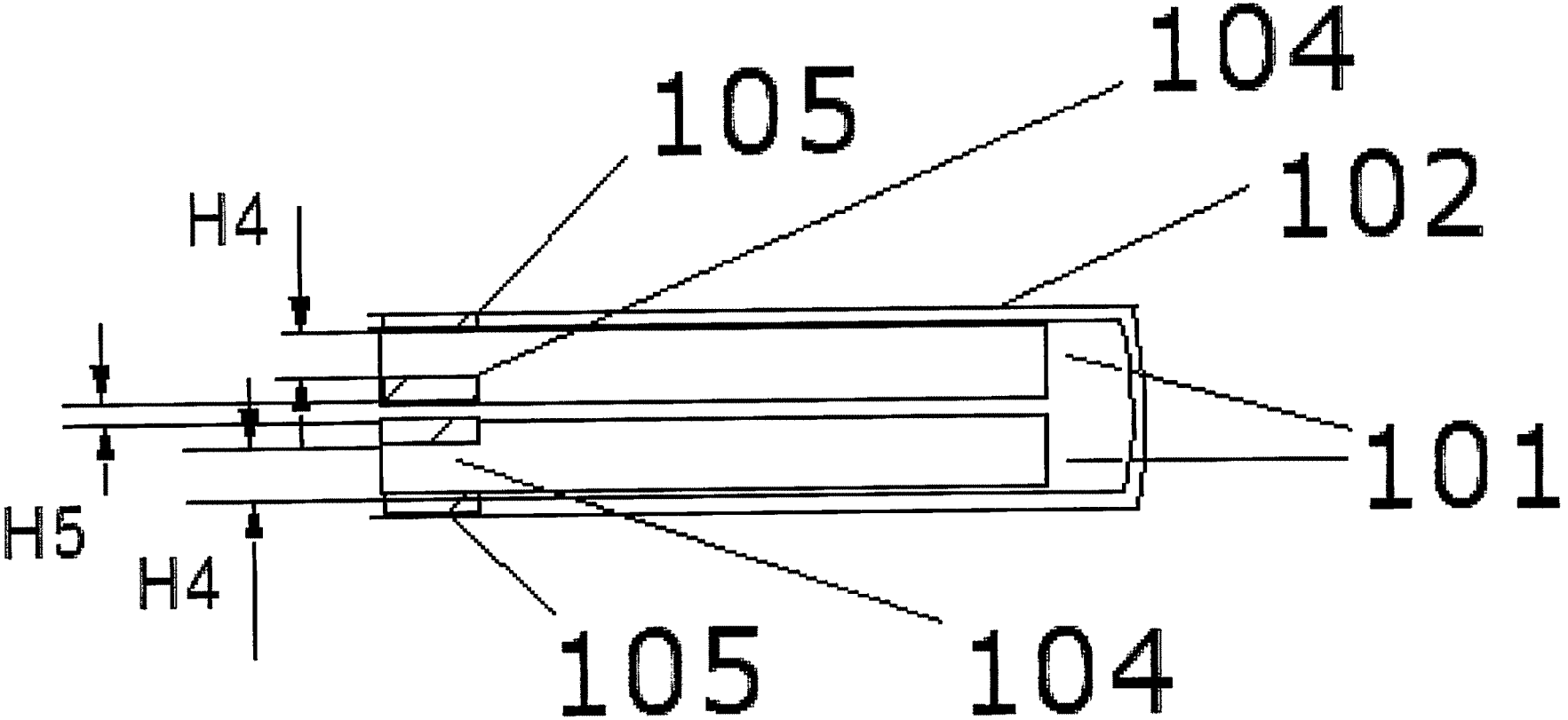

FIG. 10 shows a cross-sectional side view of the device described in FIGS. 9*a*-9*b*. The plane of the cross-section slices through a set of engaged holder magnets 105 and a corresponding set of container magnets 104 embedded in the containers and flexible holder. The distance between each of the container magnets 104, and the nearest flexible holder magnet 105 is H4. The distance between a pair of adjacent container magnets 104 is H5. In this example H4 is greater than H5. As described in FIGS. 9*a* and 9*b*, when the device is opened it will first open between the flexible holder and the container exposing either product opening 120*c* or 120*d* due to the configuration of magnetic forces. The device will not open first between the two containers when the device is operated as configured.

Figure 11A:
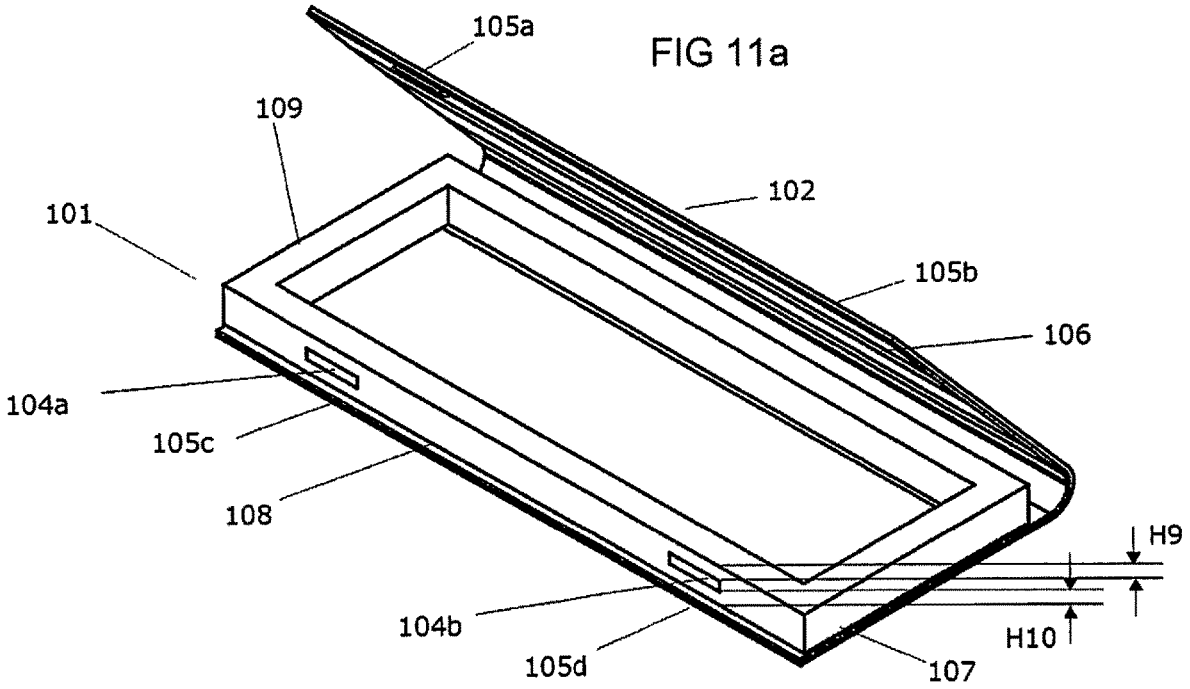
Figure 11B:
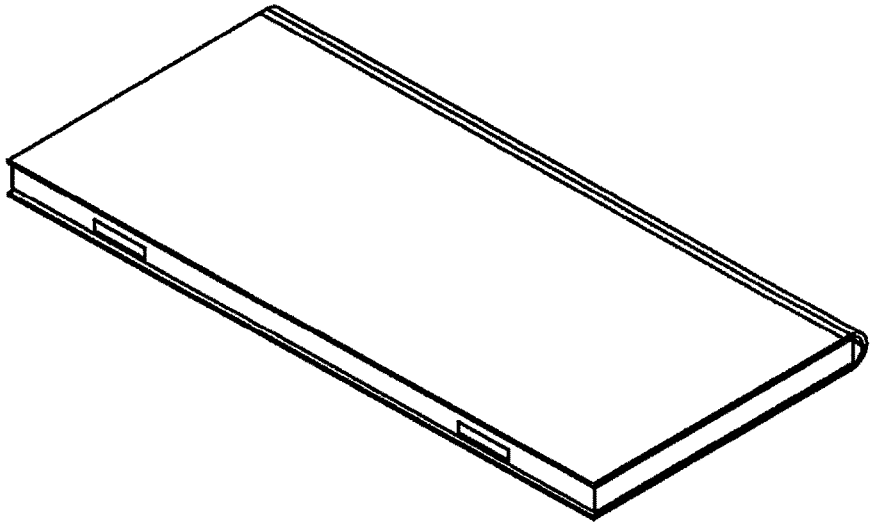

FIG. 11*a*-11*b* describe an exemplary embodiment of the device containing magnets of different strengths. In this FIG. 11*a* shows the container 101 embedded with magnets 104*a* and 104*b*. In this figure, both magnets are approximately level with each other. There is a container top surface level 109 and a container bottom surface level 108. H9, representing the distance between the upper surface of the holder magnet 104*b* on the right side and the container top surface, is approximately equal to H10 representing the distance between the lower surface of the holder magnet 104*b* on the right side, and the container bottom surface. Likewise, the distance between the upper surface of the holder magnet 104*a* on the left side and the container top surface, is approximately equal to the distance between the lower surface of the holder magnet 104*a* on the left side and the container bottom surface. The container is inserted into a flexible holder 102 with upper surface 106 and lower surface 107. The holder magnets 105*a* and 105*c* are vertically aligned with the container magnet 104*a*. The holder magnets 105*b* and 105*d* are vertically aligned with the container magnet 104*b*. The strength of the holder magnets 105*a* and 105*b* are weaker than the strength of the holder magnets 105*c* and 105*d*. Therefore, the magnetic attraction between the magnet pairs 105*a* and 104*a*, and 105*b* and 104*b*, are respectively weaker than the magnetic attraction between the magnets 105*c* and 104*a*, and between 105*d* and 104*b*. The device will first open between the holder upper surface, and the container top surface as there is less attractive force than between the holder lower surface and the container bottom surface.

FIG. 11*b* shows the same device in a closed position before the device is opened as described above.

The embodiments described in FIGS. 5-11, including a pair of horizontally aligned magnets embedded within each container and within each holder, are exemplary and do not limit the scope of the present disclosure. Other variations of a device as disclosed herein may be employed. In various embodiments, magnets may be all oriented in the same direction or, one set of vertically aligned magnets may be oriented such that their north pole faces upwards and their south pole faces downwards. For instance, referring to FIG. 7 holder magnets 105 *a*-105*d* can all face north as long as the corresponding container magnets 104*a*-104*b* also face north or, are magnetizable elements.

In various embodiments, magnetizable elements such as certain steels can be substituted for the magnets in the flexible holder as long as there are corresponding magnets in the containers that are sufficiently strong and correctly positioned such that they can engage the magnetizable elements.

In various embodiments, multiple containers may be inserted into the holder. Instead of the variable distances shown in FIGS. 9*a*-9*b*, the holder magnets 105 can be configured to be weaker than the container magnets 104. The distances between vertically aligned container magnets can be configured to be the same as the distances between adjacent and vertically aligned pairs of holder and container magnets. Because the magnetic attractive force between the stronger container magnets are greater than the magnetic forces between container magnets and the holder magnets, the device will still first open between the latter pairs of magnets. Other variations are contemplated to be within the scope of the present disclosure.

Figure 12:
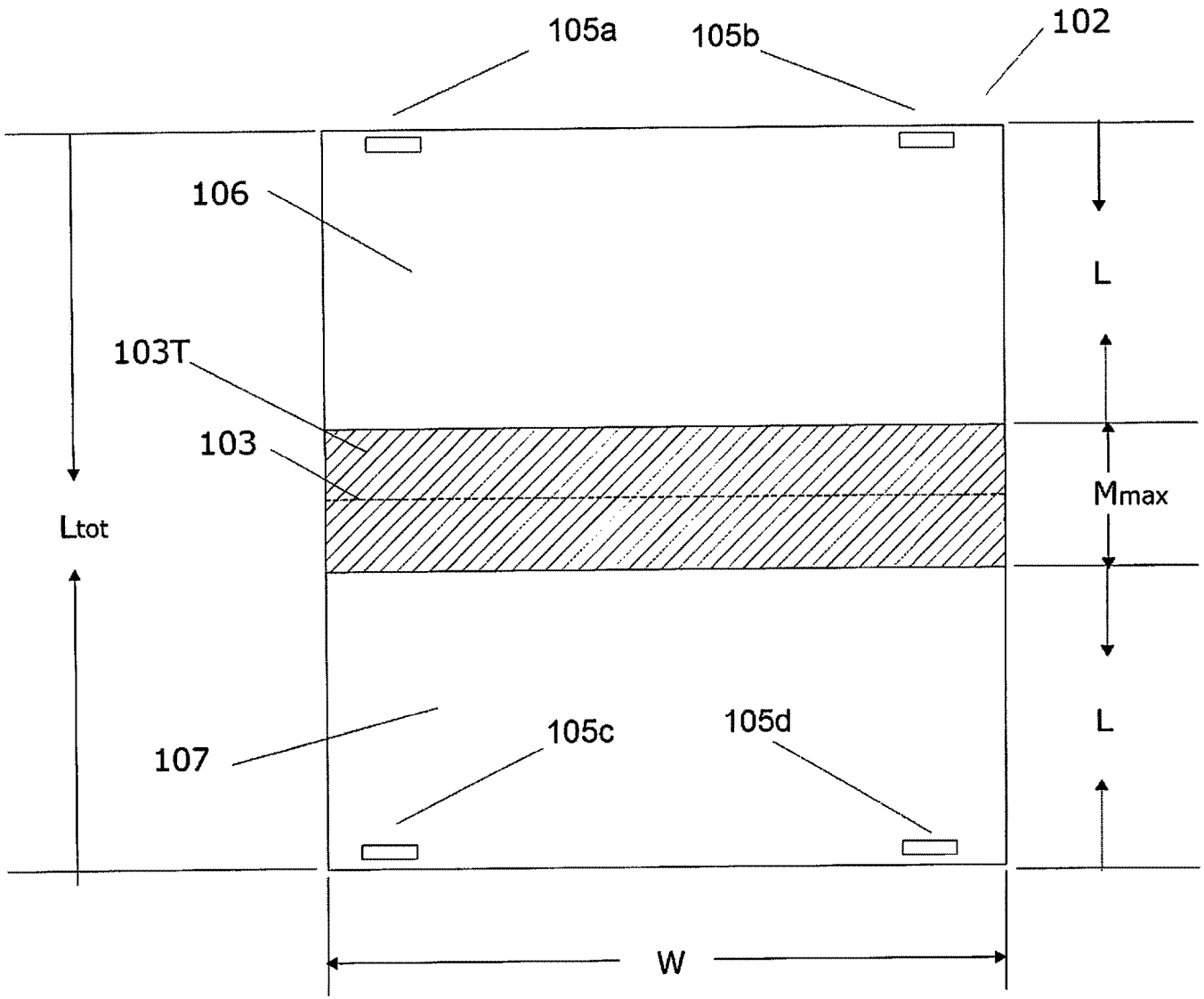
FIGS. 12-14 depict a device embodiment whose holder can accommodate variable numbers of containers.

FIGS. 12 and 13 describe various aspects of the device holder.

FIG. 12 shows the flexible holder 102 as described in FIG. 1 spread open to show one possible layout of the holder's components, including one possible configuration of the embedded holder magnets 105*a*-105*d*. In this embodiment, the two sets of magnets are embedded within the top and bottom edges of the flexible holder. When folded along the folding axis as shown in FIG. 1, the magnet 105*b* is positioned approximately above magnet 105*d*, and magnet 105*a* is positioned approximately above 105*c*.

Immediately surrounding the folding axis are folding area 103T, whose height is $M_{max}$ and width is W. These areas are designed to allow variable quantities of containers to be inserted into the device. This is further described later. The container upper and lower regions 106 and 107, whose respective heights are each L and, whose width is W, describe the approximate areas onto which containers would be placed such that their magnets would engage with the holder magnets, as has been described above. The container regions are the approximate areas that describe the surface between the respective holder magnets and the folding axis.

Figure 13A:
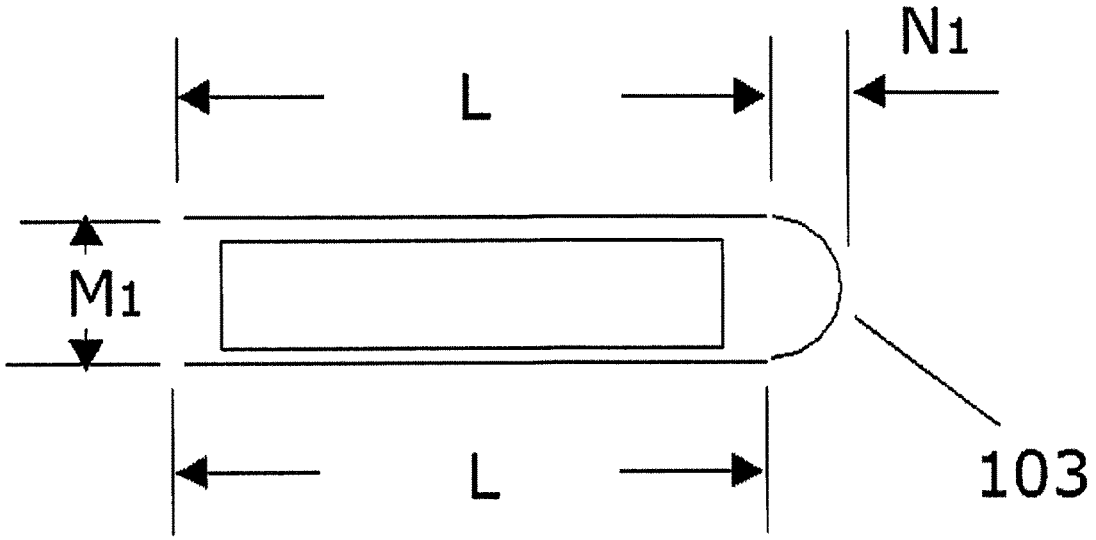

FIG. 13*a* shows a schematic of a side view of the flexible holder when it folded and when one container is inserted as is described in FIG. 11 and FIGS. 1-7. The height of the bendable portion/bendable zone 103T is $M_1$ and the folding axis protrudes outwards by $N_1$. L represents each of the heights of the container regions 106 and 107 as described in FIG. 11.

Figure 13B:
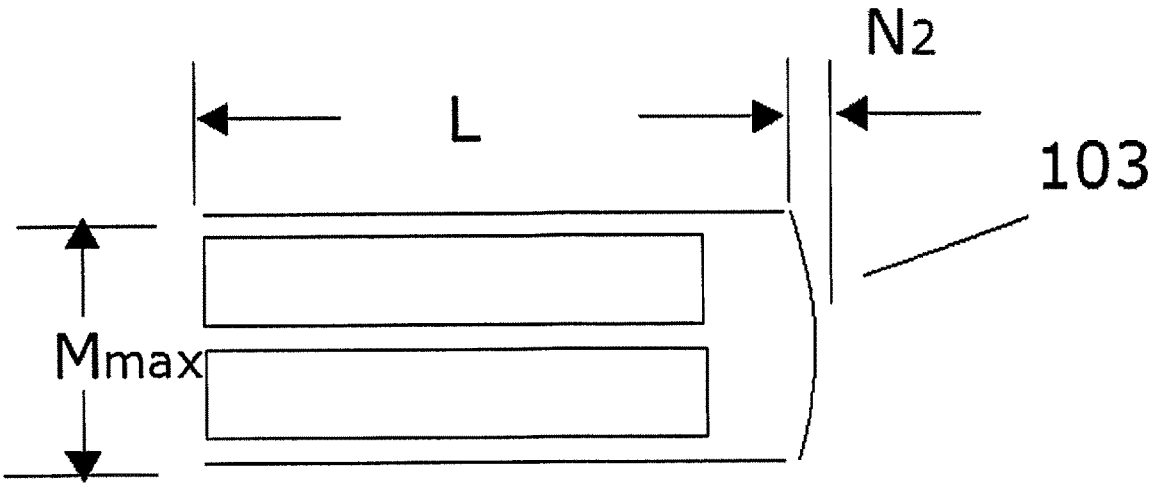

FIG. 13*b* shows a schematic of a side view of the container when it is folded and when more than one container is inserted as described in FIG. 12 and FIGS. 8 and 9. The height of the container is approximately and does not exceed $M_{max}$, and the folding axis protrudes outwards by the minimal distance $N_2$, where $N_2$ is close to zero. L1 and L2 represent the heights of the container regions 106 and 107 as described in FIG. 12.

In various embodiments, the container regions would be constructed with a material such as cardboard or plastic to help support the containers, encased by a flexible fabric or leatherette material that would extend into the folding areas. The flexible material would allow the folding areas to bend, flex, or stretch as needed to accommodate the containers when they are in a closed position. But, the container areas do not necessarily need to be so stiffened. The holder could be constructed entirely of one or more flexible materials flexible material.

In various embodiments, the device contains substantially strong rare earth neodymium magnets. In various embodiments, other magnetic or magnetizable materials can be used including ferrous magnets, rubber magnets, nickel, or magnetizable steel or iron.

The shapes of the flexible holder are not limited to a rectangle. In various embodiments, circles, semicircles, hexagons, or amorphous two-dimensional shapes can be employed. In various embodiments, various textures or accessories might be incorporated on the outer surface of the holder. Or, the total area of the holder might be larger or, extend beyond the area that defines the container regions and the folding areas. These embodiments will still permit the device to function as described, as long as the relationship between the folding axis and the holder magnets allow the holder to bend such that the magnets can engage with the containers as described above.

Furthermore, the folding area could be comprised of materials such as thin polypropylene, non-woven nylon or even a stretchable material such as rubber. The material only needs to be sufficiently flexible to allow a holder to accommodate different numbers of containers or, containers of various heights.

Figure 14:
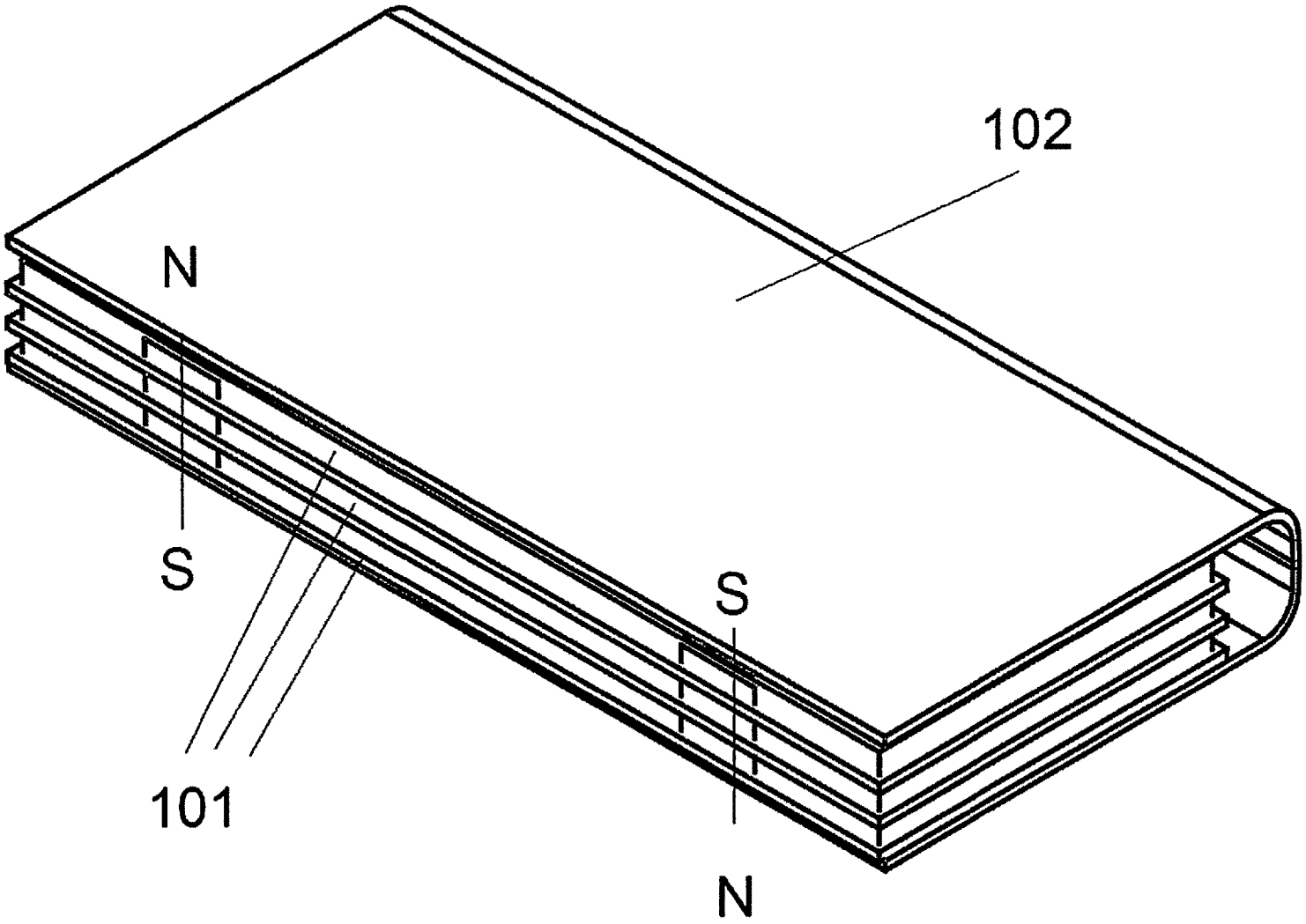

FIG. 14 shows an example of the device with the holder 102 expanded to include three containers 101.

Figure 15A:
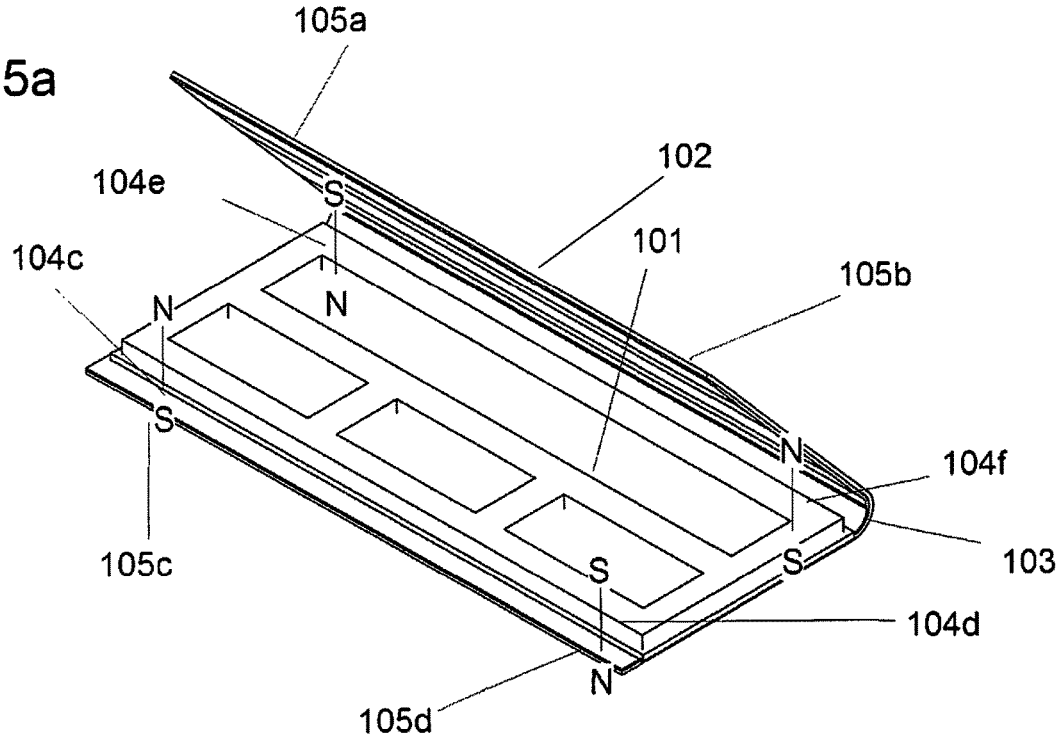
FIGS. 15*a*-15*b* show how a container with four magnets can allow it to be inserted into a holder in two different lateral orientations.
Figure 15B:
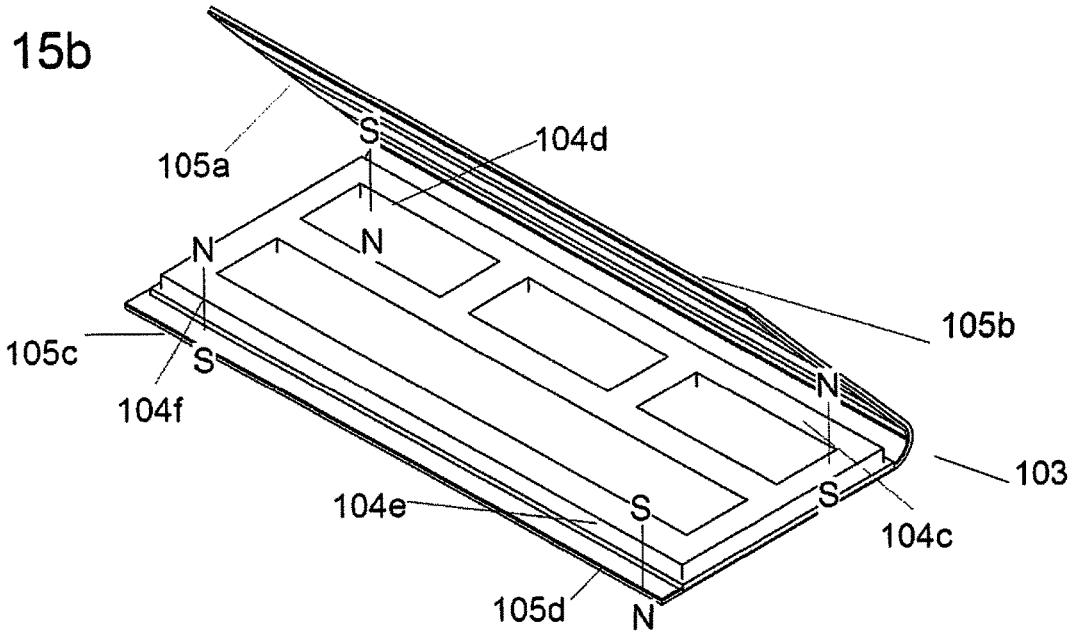

FIG. 15*a* shows a device where the container 101 contains four container magnets 104*c*-104*f* whose north-south orientations alternate. Additionally, any two adjacent polarities in the container are configured to be opposite to each other. As used herein, two polarities are "adjacent" among a set of polarities if the two polarities share an edge of a polygon or polyhedron that has vertices located at the set of polarities. Container magnets 104*c* and 104*d* are positioned along or adjacent to a front end of the container, and container magnets 104*e* and 104*f* are positioned along or adjacent to a back end of the container. In FIG. 15*a*, container magnets 104*c*-*d* are positioned opposite of the holder 102 folding axis 103, adjacent to an outside edge of the holder 102, such that container magnet 104*c* can engage with holder magnets 105*a* and 105*c*, and container magnet 104*d* can engage with holder magnets 105*b* and 105*d*. The container magnets 104*e* and 104*f* are positioned adjacent to the holder folding axis 103. In this orientation, the back end of the container abuts the folding axis 103. FIG. 15*b* shows the device where the container 101 is rotated 180 degrees such that the magnet 104*f* can engage with holder magnets 105*a* and 105*c*, and container magnet 104*e* can engage with holder magnets 105*b* and 105*d*. The container magnets 104*c* and 104*d* are positioned adjacent to the holder folding axis 103. In this orientation, the front end of the container abuts the folding axis 103. This configuration, together with the aspects described in FIGS. 3*a*-3*e*, allows consumers to position the container within the holder in any orientation and be assured that the magnets will always engage with each other regardless of the orientation. In various embodiments, for added stability, additional magnets or magnetizable elements may be inserted in the back of the holder toward the side of the folding axis.

Figure 16:
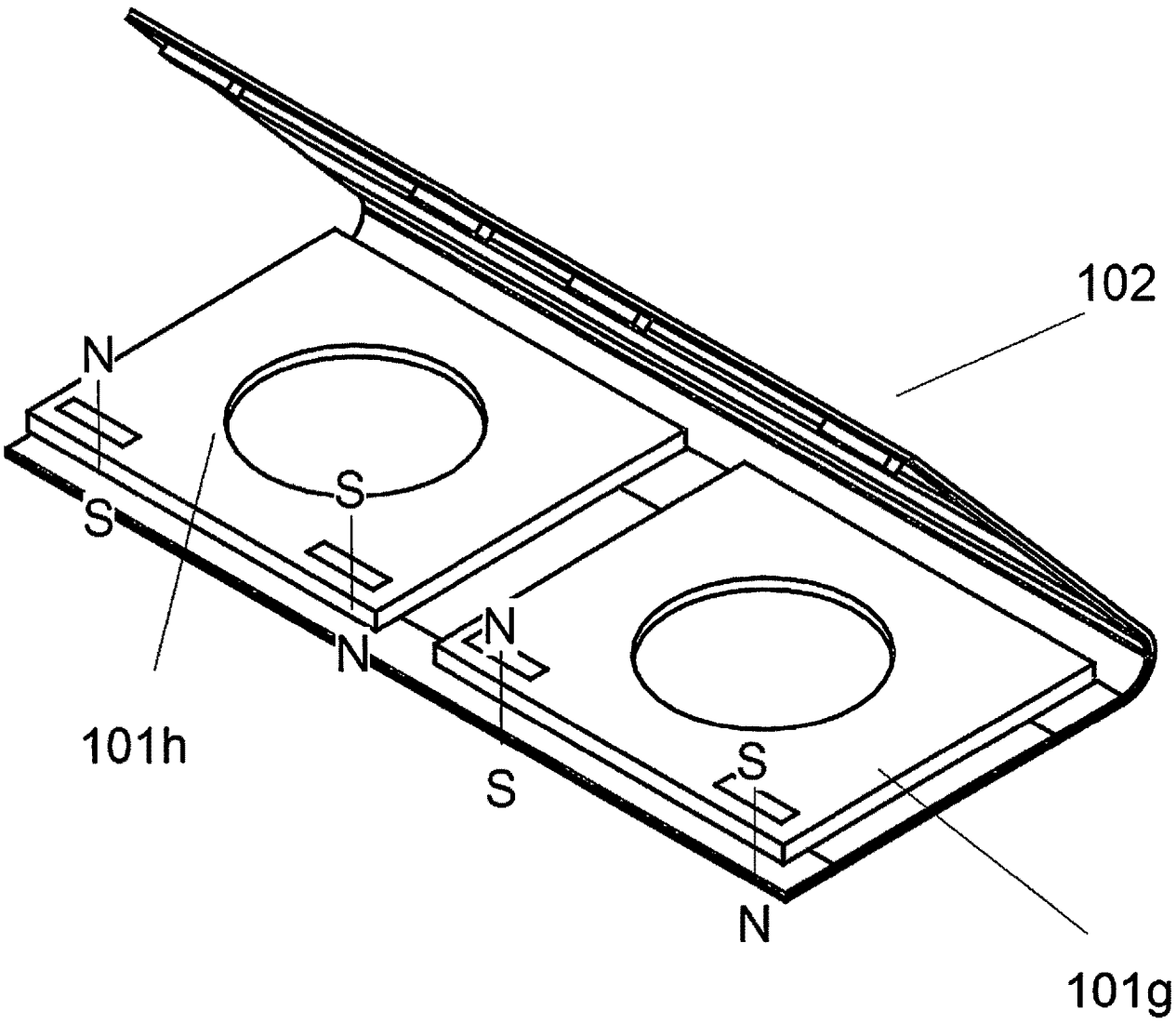
FIG. 16 shows a flexible holder with two containers inserted adjacent to each other.

FIG. 16 shows a flexible holder with two containers inserted adjacent to each other on the same plane. Beneath the two containers are embedded corresponding magnets configured with the illustrated poles and positions.

Figure 17:
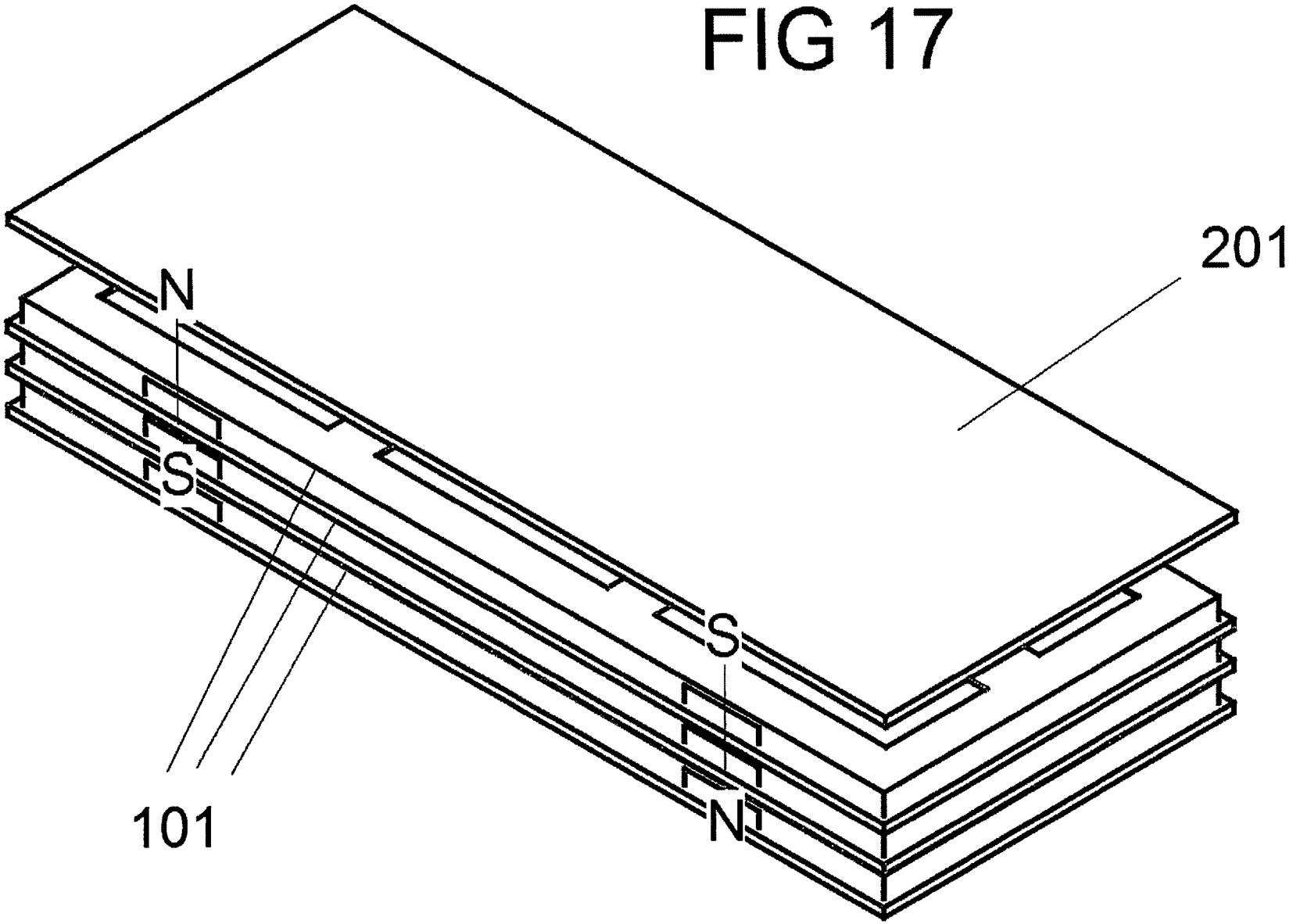
FIG. 17 shows how containers may be removed from a flexible holder and stored separately as a stackable set of containers.

FIG. 17 shows how containers may be removed from a flexible holder and stored separately as a stackable set of containers 101, with a container cover 201 configured to engage with the magnets within the containers.

Figures 18A, 18B, 18C, 18D:
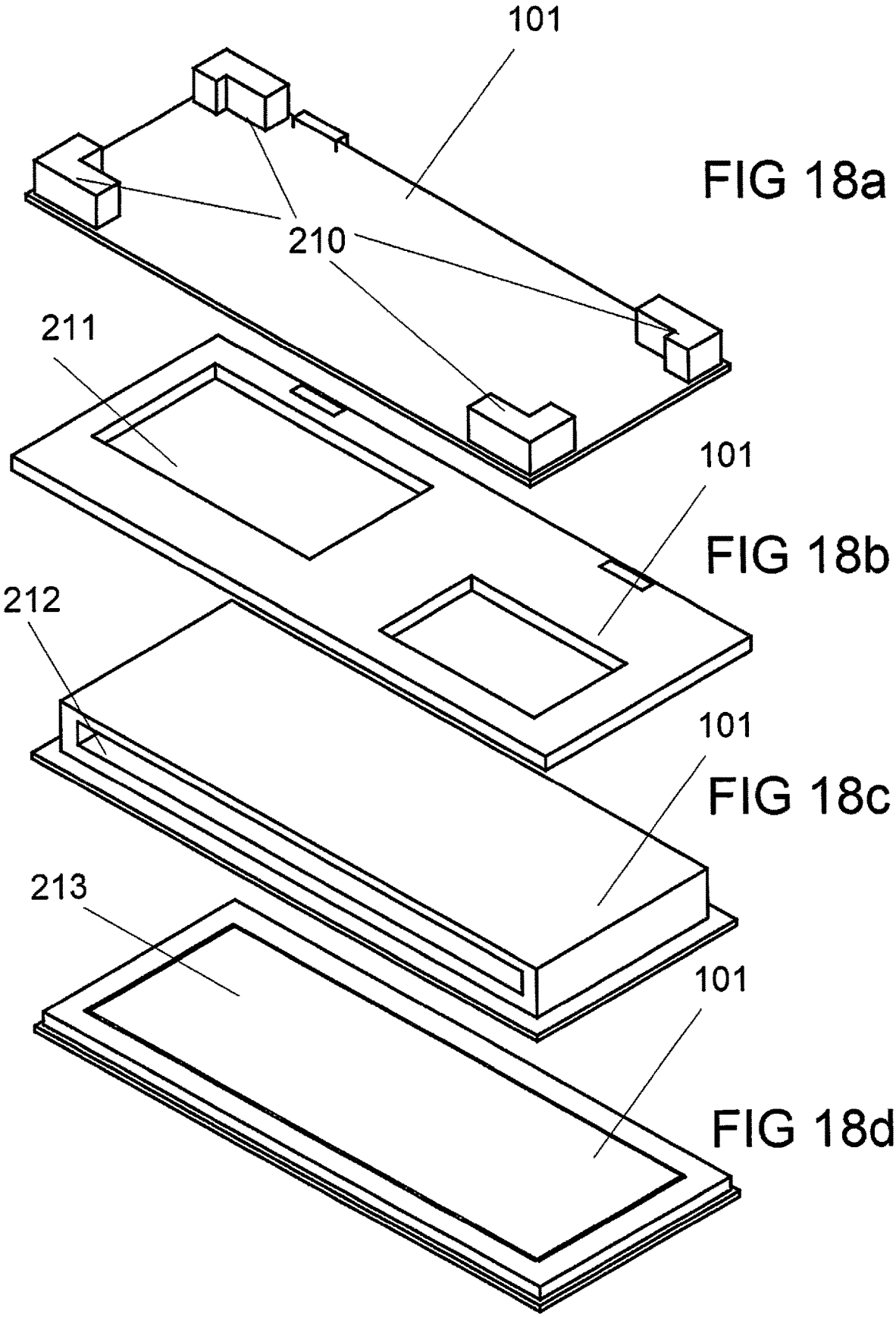
FIGS. 18*a*-18*d* depict various configurations of product areas in a container of an embodiment.

FIGS. 18*a*-18*d* depict various possible configurations of product areas in a container 101. In FIG. 18*a*, the walls 210 are limited to the corners of the container. In FIG. 18*b*, the container has shallow product areas 211 that might hold a mirror or photograph. FIG. 18*c* shows a container with access to the product is through a side cavity 212. FIG. 18*d* shows a container with a product area 213 that is within the entire middle area of the container. There are many other variations of configurations for the container. The configuration is dependent on the functionality. For example, a container can be configured to hold product on the top surface as well as the bottom surface. The container could also use straps or catches to assisting in holding product within the product areas.

Figure 19B:
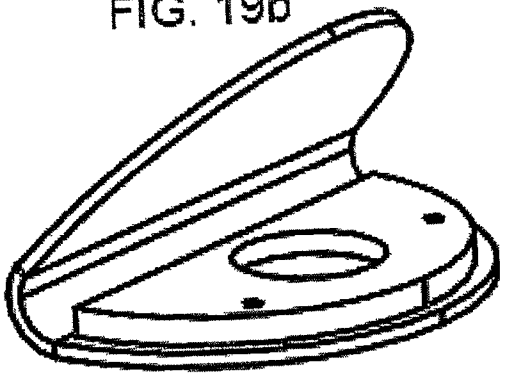
FIGS. 19*a*-19*d* show various configurations of shapes of the containers and the holders.
Figure 19D:
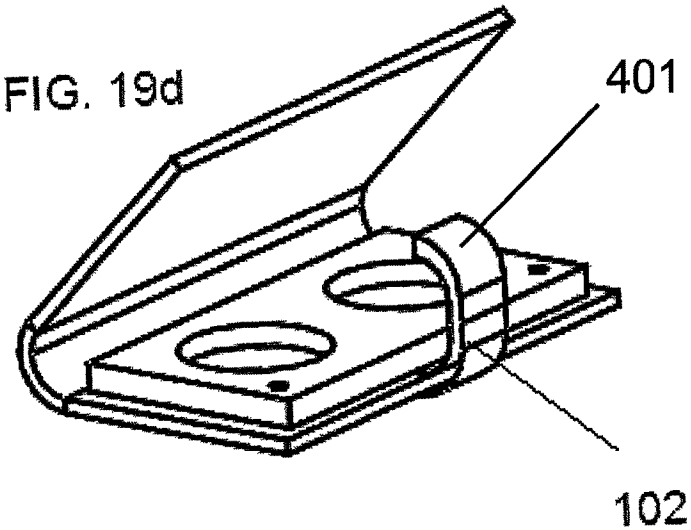
Figure 19A:
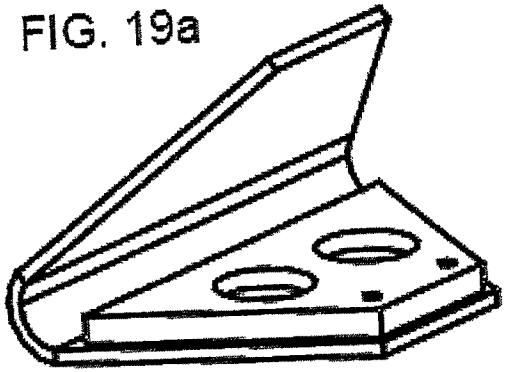
Figure 19C:
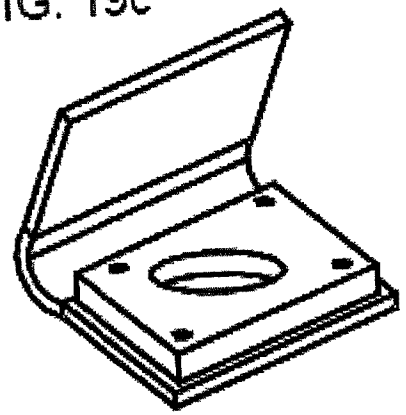

FIGS. 19*a*-19*d* show various shapes of the holders 102 and containers 101. Although previous embodiments described or illustrated herein include rectangular holders and containers, other shapes may be used such that the holder and container magnets or magnetizable elements may mutually engage, and incorporate the features described above herein. FIGS. 19*a* and 19*b* show trapezoidal and semicircular containers. FIG. 19*c* shows a square container with four magnets positioned at each corner. FIG. 19*d* shows a rectangular container and a rectangular holder 102 with a strap 401 extending from the front. The strap may wrap around the holder and attach to it to assist in securing the device. In various embodiments, the containers and the holders need not be of the same shape or size, as long as the magnets embedded within these device components are positioned to engage with each other such that the device will work as described above herein.

Figure 20A:
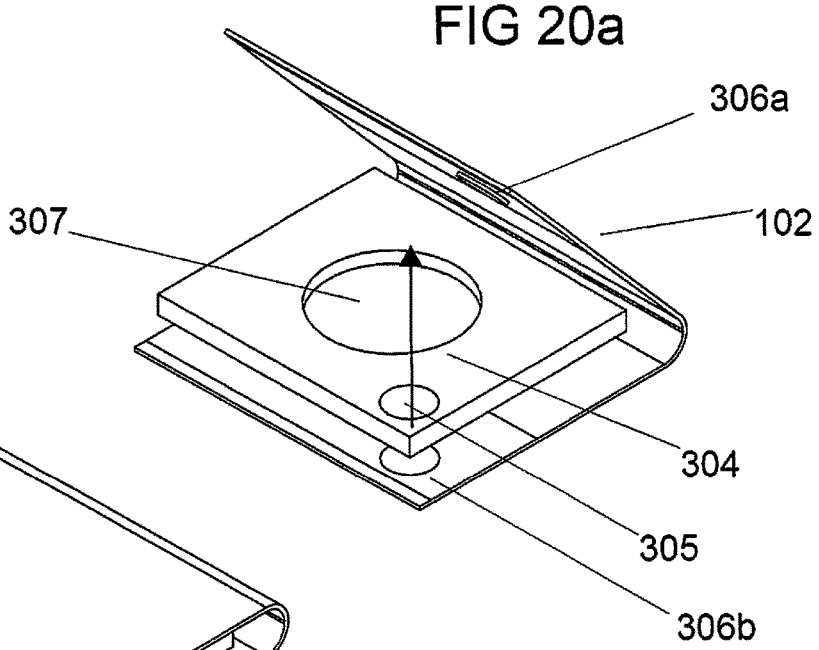
FIGS. 20*a*-20*c* show another embodiment of the concepts described in FIGS. 5-11*b* wherein the container may swivel around an axis perpendicular to a magnet enclosed within the container.
Figure 20B:
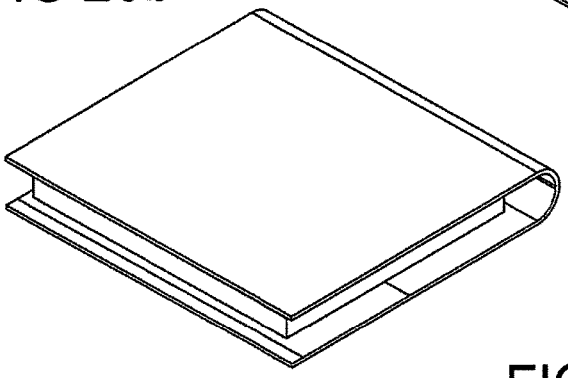
Figure 20C:
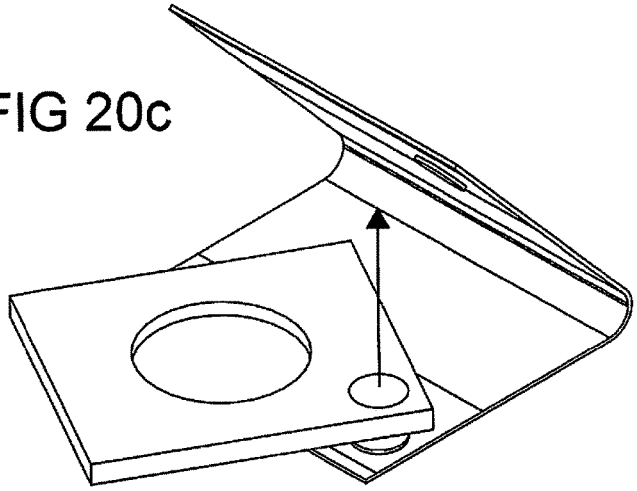

FIGS. 20*a*-20*c* show another embodiment wherein the container may swivel around an axis perpendicular to a magnet enclosed within the container. FIG. 20*a* shows a holder 102 and a container 304 with a container magnet 305 engaging with holder magnets 306*a* and 306*b* such that the device opens in a manner described above in FIGS. 5-11. FIG. 22*b* shows the same device in a closed position. FIG. 22*c* shows the device with the container 304 swivels about a vertical axis defined by the magnets 306*a*, 305, and 306*b*.

Figure 21:
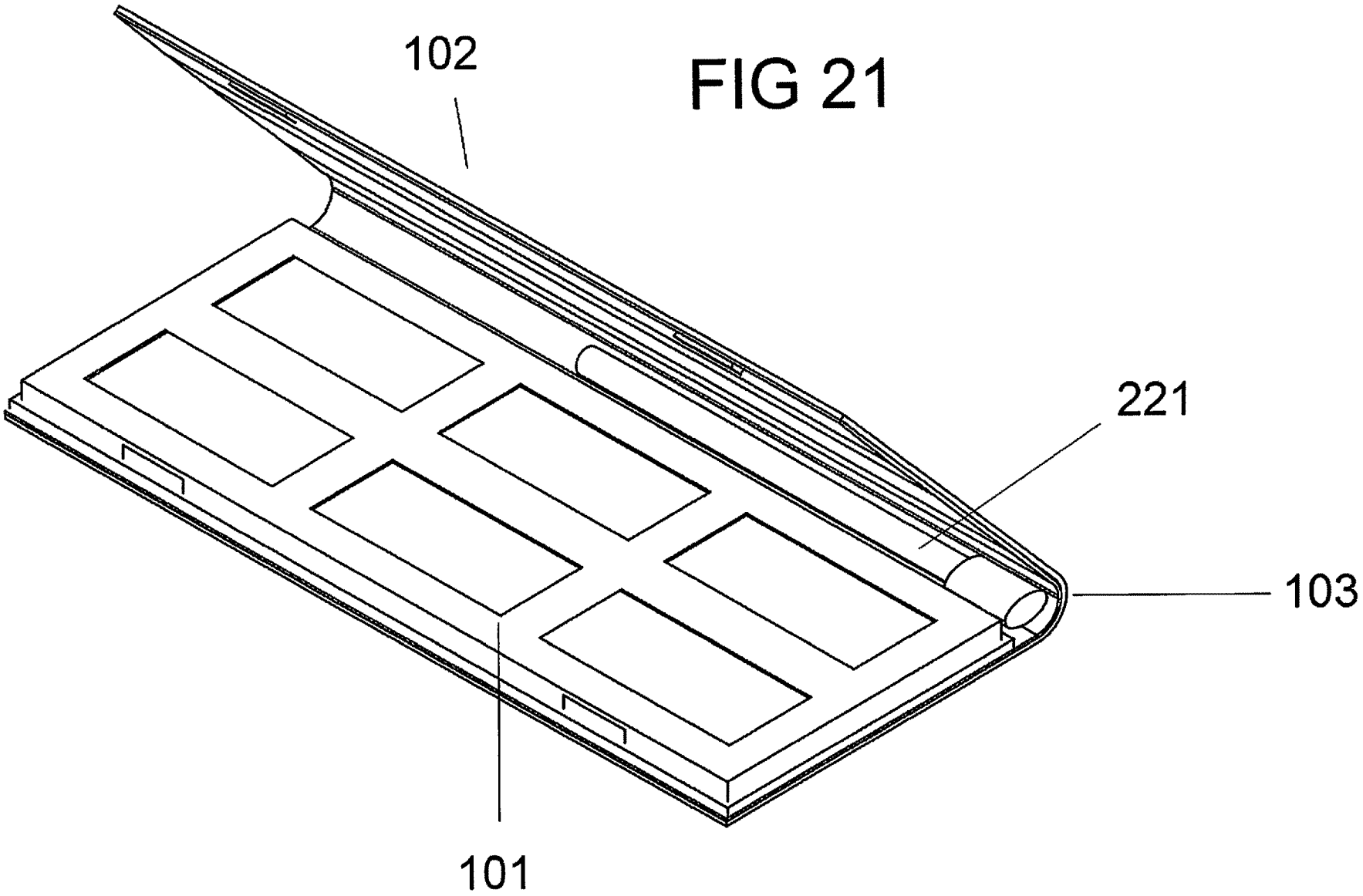
FIG. 21 shows an embodiment comprising a device into which a thin item such as a brush can be inserted at the folding axis of the flexible holder.

FIG. 21 shows an embodiment comprising a device into which a thin item such as a brush 221 can be inserted adjacent to the folding axis 103 of the flexible holder. A brush as shown in FIG. 21 can be used in conjunction with other embodiments disclosed herein.

Figure 22:
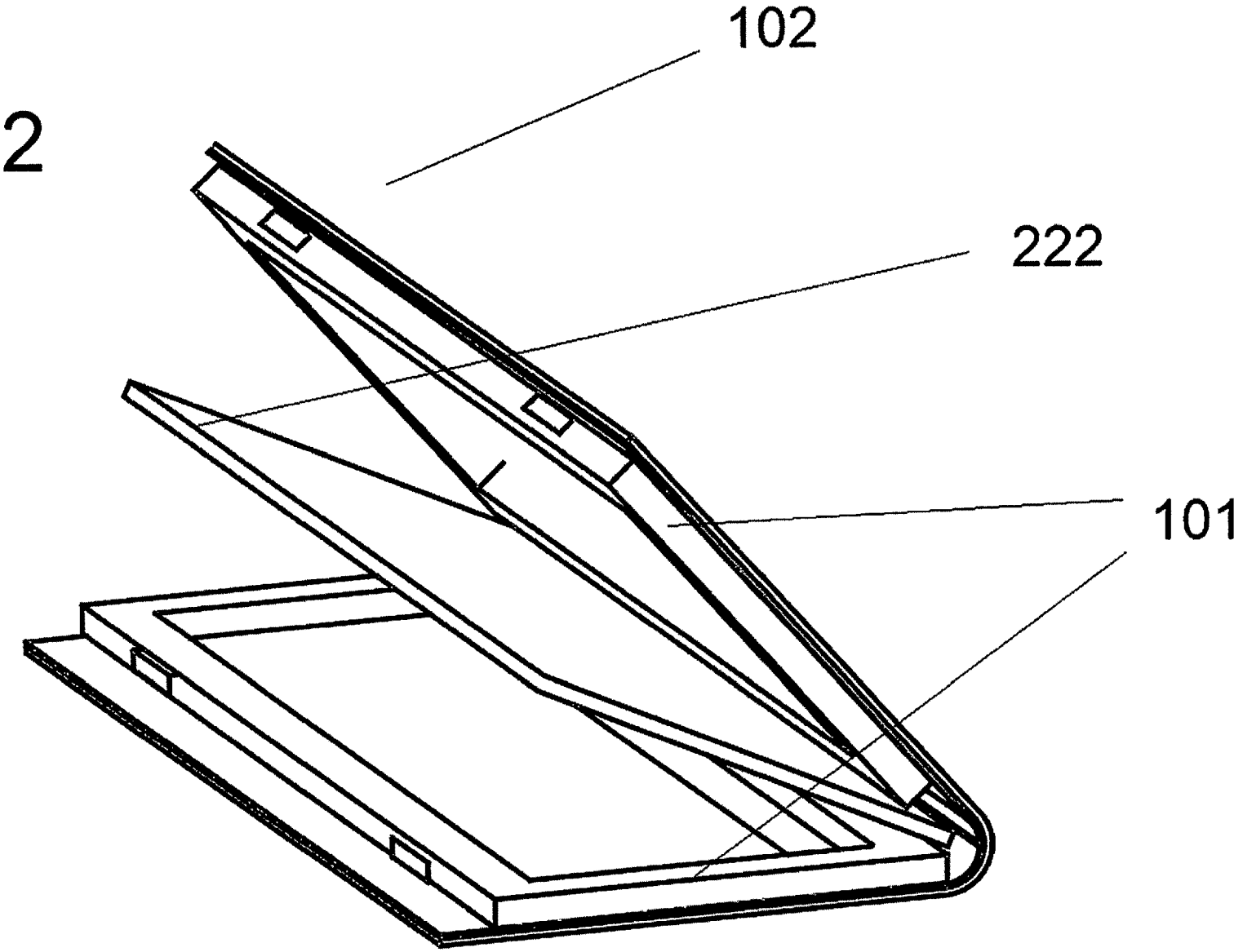
FIG. 22 shows an embodiment of the device where a septum is inserted between multiple containers or, a holder and a container.

FIG. 22 shows an embodiment of the device where a septum 222 is inserted between multiple containers 101 and inserted into the holder 102. The septum may or may not be attached to the container or the holder. The function of the septum is to prevent product from falling out of the container. A septum as shown can be used in conjunction with other embodiments disclosed herein.

Figure 25:
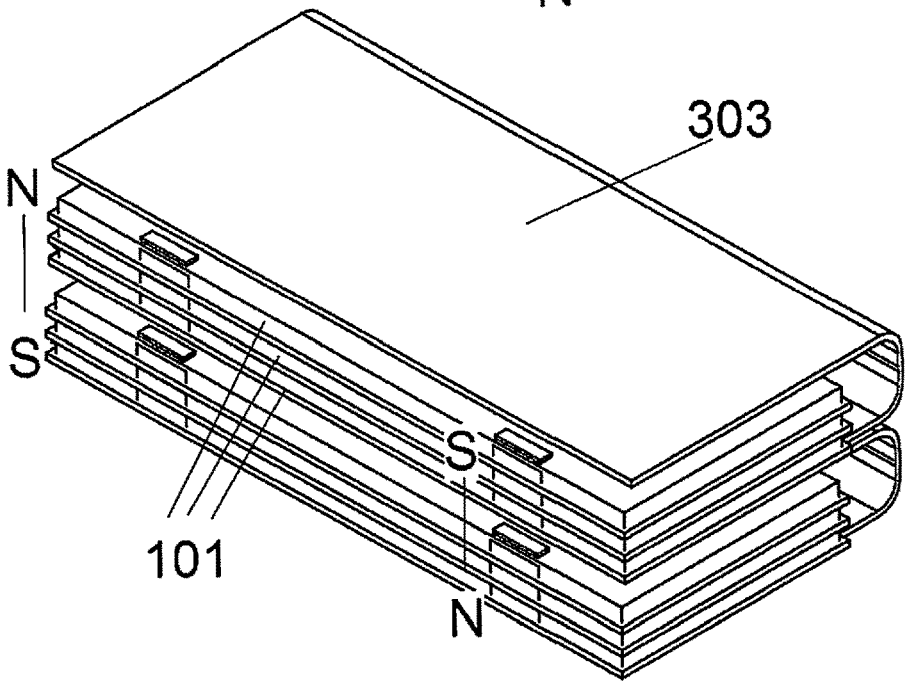

FIGS. 23-25 show an embodiment of the device where the holder is comprised of more than one compartment.

Figure 23A:
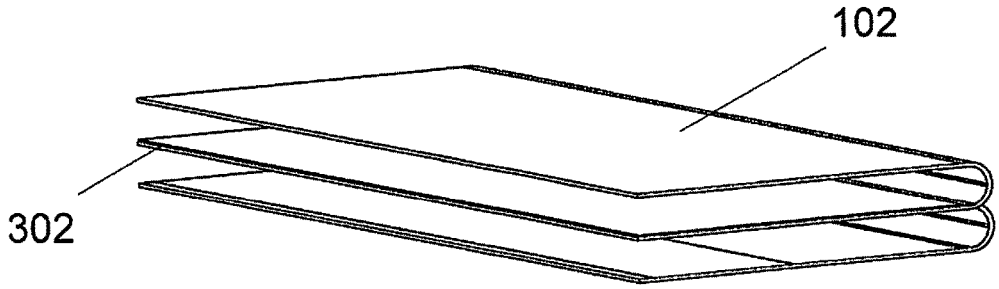
FIGS. 23*a*-25 show an embodiment of the device where the holder is comprised of more than one compartment.
Figure 23B:
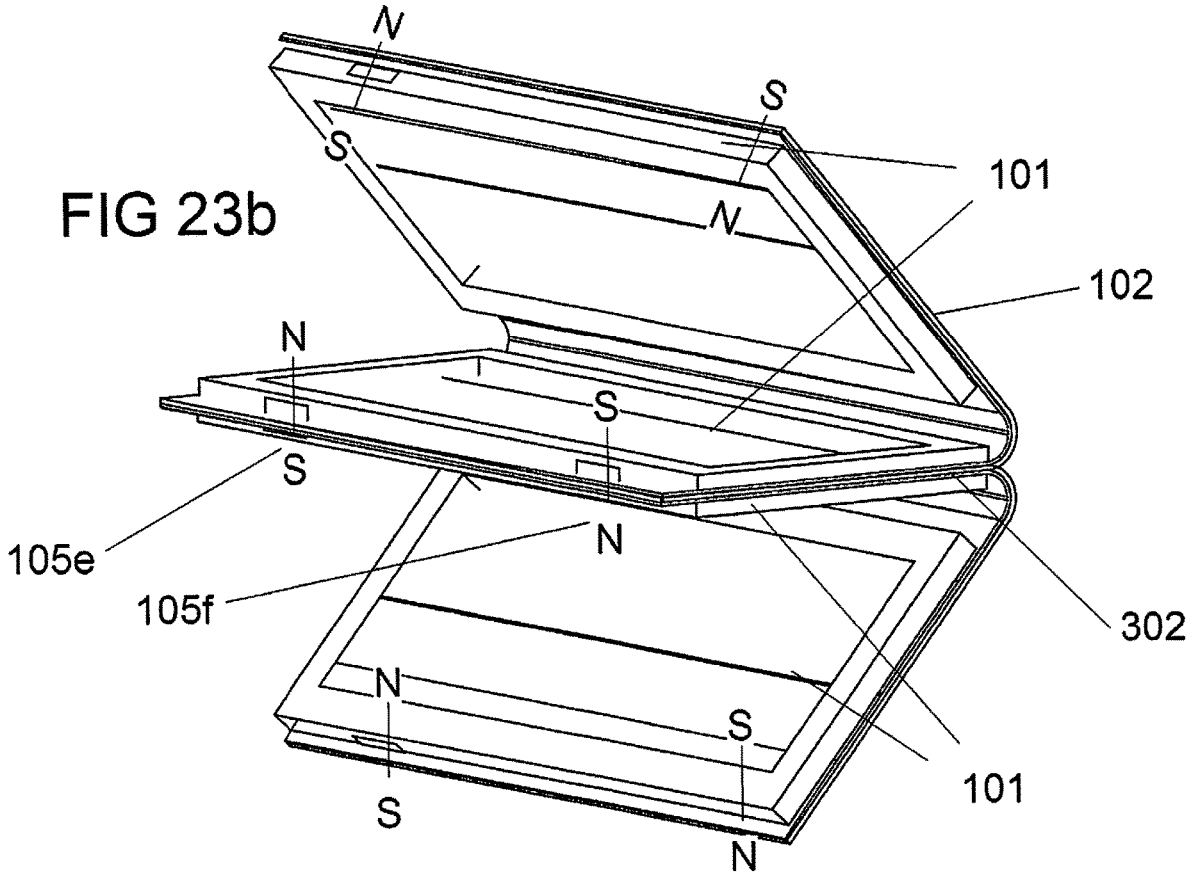

FIG. 23*a* shows a holder 102 with two compartments whose common wall 302 is part of the holder. FIG. 23*b* shows the holder 102 with containers 101 inserted within. The holder contains three sets of magnets. Those sets are as described above. A third set of magnets are embedded within the common wall 302.

FIG. 24 shows a variation of FIGS. 23*a*-23*b* with a holder 303 whose common wall is comprised of two sections 304 connected at a common edge by magnets.

FIG. 25 shows the device in FIG. 24 with a holder 303 with six containers 101 inserted within.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An apparatus comprising:

a holder comprising a flexible sheet with a foldable portion that is foldable along an axis to form an upper portion and a lower portion of said flexible sheet, wherein said upper portion contains at least one magnet embedded therein and said lower portion contains at least one magnet embedded therein; and at least one rigid container dimensioned to fit within said holder when said holder is folded, said rigid container having at least a first magnet, said at least a first magnet located to engage said at least one magnet embedded in said lower portion of said holder and said at least one magnet embedded in said upper portion of said holder, wherein the at least a first magnet of the at least one rigid container, the at least one magnet embedded in the lower portion of the holder, and the at least one magnet embedded in the upper portion of the holder, are positioned and configured such that the at least one rigid container is magnetically held by both the upper portion and the lower portion of the holder, and such that only one of the upper portion or the lower portion detaches first from the at least one rigid container when the upper portion and the lower portion of the holder are pulled apart, due to greater or lesser magnetic attraction.

2. An apparatus comprising:

a holder having an upper portion, a lower portion, and a bendable portion between the upper portion and the lower portion, wherein the upper portion includes at least two upper portion magnets and the lower portion includes at least two lower portion magnets; and a container sized to fit into the holder, wherein the container includes at least two container magnets and is secured to the holder only by magnetic forces, wherein the at least two container magnets, the at least two upper portion magnets, and the at least two lower portion magnets are positioned and configured such that the container is magnetically held by both the upper portion and the lower portion of the holder, and such that only one of the upper portion or the lower portion detaches first from the container when the upper portion and the lower portion of the holder are pulled apart, due to greater or lesser magnetic attraction.

3. The apparatus of claim 2, wherein the upper portion of the holder detaches first from the container, wherein the at least two upper portion magnets have a lesser total magnetic attraction to the at least two container magnets than a total magnetic attraction of the at least two lower portion magnets to the at least two container magnets.

4. The apparatus of claim 3, wherein the lesser total magnetic attraction is based on at least one of: the at least two upper portion magnets having less total magnetic strength than the at least two lower portion magnets, or the at least two upper portion magnets being a greater total distance away from the at least two container magnets than the at least two lower portion magnets.

5. The apparatus of claim 2, wherein the lower portion of the holder detaches first from the container, wherein the at least two lower portion magnets have a lesser total magnetic attraction to the at least two container magnets than a total magnetic attraction of the at least two upper portion magnets to the at least two container magnets.

6. The apparatus of claim 5, wherein the lesser total magnetic attraction is based on at least one of: the at least two lower portion magnets having less total magnetic strength than the at least two upper portion magnets, or the at least two lower portion magnets being a greater total distance away from the at least two container magnets than the at least two upper portion magnets.

7. An apparatus comprising:

a holder having an upper portion, a lower portion, and a bendable portion between the upper portion and the lower portion, wherein the upper portion includes at least two upper portion magnets and the lower portion includes at least two lower portion magnets;

an upper container sized to fit into the holder, wherein the upper container includes at least two upper container magnets and is secured to the upper portion of the holder only by magnetic forces; and a lower container sized to fit into the holder, wherein the lower container includes at least two lower container magnets and is secured to the lower portion of the holder only by magnetic forces, wherein the at least two upper container magnets, the at least two lower container magnets, the at least two upper portion magnets, and the at least two lower portion magnets are positioned and configured such that the upper container and the lower container are magnetically attracted to each other, and such that the upper container and the lower container only detach first from each other when the upper portion and the lower portion of the holder are pulled apart due to greater or lesser magnetic attraction.

8. The apparatus of claim 7, wherein the upper container and the lower container have a lesser magnetic attraction to each other than both a magnetic attraction of the upper container to the upper portion of the holder and a magnetic attraction of the lower container to the lower portion of the holder.

9. The apparatus of claim 7, wherein the at least two upper portion magnets include two upper portion magnets having opposite polarities and the at least two lower portion magnets include two lower portion magnets having opposite polarities.

10. The apparatus of claim 9, wherein the two upper portion magnets and the two lower portion magnets are configured such that any two adjacent magnets have opposite polarities.

* * * * *